US010435825B2

(12) United States Patent
MacGilbert et al.

(10) Patent No.: US 10,435,825 B2
(45) Date of Patent: Oct. 8, 2019

(54) FOOTWEAR UPPER WITH KNITTED COMPONENT AND METHOD OF MANUFACTURING THE SAME

(71) Applicant: NIKE, Inc., Beaverton, OR (US)

(72) Inventors: John S. MacGilbert, Tigard, OR (US); William C. McFarland, II, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 298 days.

(21) Appl. No.: 15/404,589

(22) Filed: Jan. 12, 2017

(65) Prior Publication Data

US 2017/0202295 A1 Jul. 20, 2017

Related U.S. Application Data

(60) Provisional application No. 62/279,440, filed on Jan. 15, 2016.

(51) Int. Cl.
*D04B 1/10* (2006.01)
*D04B 7/30* (2006.01)
(Continued)

(52) U.S. Cl.
CPC ..... *D04B 1/108* (2013.01); *A43B 1/04* (2013.01); *D04B 1/123* (2013.01); *D04B 7/14* (2013.01);
(Continued)

(58) Field of Classification Search
CPC ..... D04B 1/108; D04B 1/123; D04B 7/04; D04B 7/30; D04B 7/14; A43B 1/04; A43B 23/042
See application file for complete search history.

(56) References Cited

U.S. PATENT DOCUMENTS 5,765,400 A 6/1998 Roell
8,448,474 B1 * 5/2013 Tatler ..... A43B 23/0245 66/64
(Continued)

FOREIGN PATENT DOCUMENTS

CN 105074070 A 11/2015
EP 0 851 050 A2 7/1998
(Continued)

OTHER PUBLICATIONS

International Search Report and Written Opinion in corresponding International Application No. PCT/US2017/013183, dated May 11, 2017, 31 pages.
(Continued)

*Primary Examiner* — Danny Worrell
(74) *Attorney, Agent, or Firm* — Brinks Gilson & Lione

(57) ABSTRACT

A method of knitting a knitted component for an upper of an article of footwear is provided. The method may include using a flat knitting machine. The upper may be configured to receive a foot of a wearer. The method may include performing a pass of at least one yarn feeder along the longitudinal axis relative to first and second needle beds, feeding at least one yarn with the at least one feeder during the pass, forming, during the pass, a plurality of first loops with the first needles to define a first portion of the knitted component, and forming, during the pass, a plurality of second loops with the second needles to define a second portion of the knitted component.

20 Claims, 15 Drawing Sheets

(51) Int. Cl.
*D04B 7/14* (2006.01)
*D04B 1/12* (2006.01)
*A43B 1/04* (2006.01)

(52) U.S. Cl.
CPC ..... *D04B 7/30* (2013.01); *D10B 2501/043* (2013.01)

(56) References Cited

U.S. PATENT DOCUMENTS

| | | | | |
|---|---|---|---|---|
| 9,467,134 | B2 * | 10/2016 | Wu | H02M 3/156 |
| 9,498,022 | B2 * | 11/2016 | Ikenaka | A43B 23/08 |
| 9,771,673 | B2 * | 9/2017 | Ikenaka | A43B 1/04 |
| 2014/0137434 | A1 | 5/2014 | Craig | |
| 2015/0173458 | A1 * | 6/2015 | Ikenaka | A43B 1/04 36/45 |
| 2015/0374062 | A1 * | 12/2015 | Ikenaka | A43B 1/04 12/142 G |
| 2016/0017524 | A1 | 1/2016 | Nishino et al. | |

FOREIGN PATENT DOCUMENTS

| | | | |
|---|---|---|---|
| EP | 0 854 050 | A2 | 7/1998 |
| EP | 2 960 362 | A1 | 12/2015 |
| JP | 2006-291439 | A | 10/2006 |

OTHER PUBLICATIONS

EP Communication dated Aug. 22, 2018 for EP Application No. 17701261.4 (3 pg.).
International Preliminary Report on Patentability and Written Opinion of the International Searching Authority Office Action dated Jul. 17, 2018 for PCT Application No. PCT/US2017/013183 (10 pg.).
Office Action in China Application No. 2017800136516, including English Translation, dated Aug. 15, 2019, 19 pages.

* cited by examiner

FOOTWEAR UPPER WITH KNITTED COMPONENT AND METHOD OF MANUFACTURING THE SAME

CROSS REFERENCE TO RELATED APPLICATIONS

This application claims priority to U.S. provisional application Ser. No. 62/279,440, filed Jan. 15, 2016, which is herein incorporated by reference in its entirety.

BACKGROUND

Conventional articles of footwear generally include two primary elements: an upper and a sole structure. The upper is secured to the sole structure and forms a void within the footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole is secured to a lower surface of the midsole and forms a ground-engaging portion of the sole structure that is formed from a durable and wear-resistant material. The sole structure may also include a sockliner positioned within the void and proximal a lower surface of the foot to enhance footwear comfort.

The upper generally extends over the instep and toe areas of the foot, along the medial and lateral sides of the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

Various materials are conventionally utilized in manufacturing the upper. The upper of athletic footwear, for example, may be formed from multiple material elements. The materials may be selected based upon various properties, including stretch-resistance, wear-resistance, flexibility, air-permeability, compressibility, and moisture-wicking, for example. With regard to an exterior of the upper, the toe area and the heel area may be formed of leather, synthetic leather, or a rubber material to impart a relatively high degree of wear-resistance. Leather, synthetic leather, and rubber materials may not exhibit the desired degree of flexibility and air-permeability for various other areas of the exterior. Accordingly, the other areas of the exterior may be formed from a synthetic textile, for example. The exterior of the upper may be formed, therefore, from numerous material elements that each imparts different properties to the upper. An intermediate or central layer of the upper may be formed from a lightweight polymer foam material that provides cushioning and enhances comfort. Similarly, an interior of the upper may be formed of a comfortable and moisture-wicking textile that removes perspiration from the area immediately surrounding the foot. The various material elements and other components may be joined with an adhesive or stitching. Accordingly, the conventional upper is formed from various material elements that each imparts different properties to various areas of the footwear.

SUMMARY

The current embodiments generally relate to a method of knitting a knitted component for an upper of an article of footwear. The method may include using a flat knitting machine. The upper may be configured to receive a foot of a wearer. The flat knitting machine may include a first needle bed with a plurality of first needles arranged along a longitudinal axis, where the flat knitting machine has a second needle bed with a plurality of second needles arranged along the longitudinal axis. The method may include performing a pass of at least one yarn feeder along the longitudinal axis relative to the first and second needle beds, feeding at least one yarn with the at least one feeder during the pass, forming, during the pass, a plurality of first loops with the first needles to define a first portion of the knitted component, and forming, during the pass, a plurality of second loops with the second needles to define a second portion of the knitted component. The first portion may define an overfoot member of the upper configured to cover over the foot of the wearer. The second portion may define an underfoot member of the upper configured to extend under the foot of the wearer.

Feeding the at least one yarn with the at least one feeder during the pass may include feeding a first yarn with a first feeder and feeding a second yarn with a second feeder during the pass. Forming, during the pass, the plurality of first loops may include forming the plurality of first loops out of the first yarn with the first needles to define the first portion of the knitted component. Forming, during the pass, the plurality of second loops may include forming the plurality of second loops out of the second yarn with the second needles to define the second portion of the knitted component.

The method may include interlooping the first yarn and the second yarn during the pass to form a joined area of the knitted component.

The knitted component may include a knit element substantially defined by a first portion and the second portion. The method may include inlaying a tensile element in the knit element. Inlaying the tensile element may include continuously extending the tensile element between the first portion and the second portion.

The method may further include forming a medial side of the knit element and forming a lateral side of the knit element, where inlaying the tensile element includes continuously extending the tensile element from the first portion on the medial side, across the second portion, to the first portion on the lateral side.

Inlaying the tensile element may include inlaying a first segment of the tensile element along the first portion, inlaying a second segment of the tensile element along the first portion, and forming a tensile loop with a third segment of the tensile element, the third segment extending between the first segment and the second segment, the third segment being exposed from the knit element.

The method may include joining the first portion and the second portion at a joined area such that the first portion and the second portion are formed unitary knit construction.

The method may include attaching a sole structure to the upper, where attaching the sole structure includes covering the joined area with the sole structure.

The pass may be a first pass and the joined area may be a first joined area. The method may include performing a second pass of the at least one yarn feeder along the longitudinal axis relative to the first and second needle beds, feeding the at least one yarn with the at least one yarn feeder during the second pass, forming, during the second pass, a plurality of third loops with the first needles to define a third portion of the knitted component, the third portion defining a front heel area of the knitted component, forming, during the second pass, a plurality of fourth loops with the second needles to define a fourth portion of the knitted component, the fourth portion defining a rear heel area of the knitted component, and joining the third portion and the fourth portion at a second joined area such that the third portion and the fourth portion are formed of unitary knit construction. The third portion and the fourth portion may be configured to cooperatively define an ankle opening of the upper, the ankle opening being configured to allow passage of the foot into the upper.

The second joined area may be substantially continuous with first joined area.

The method may include forming a tubular structure with an opening, the first portion and the second portion cooperating to define the opening. The opening may define an ankle opening that may be configured to allow passage of the foot into the upper.

The method may include knitting a first edge of the first portion and a second edge of the second portion, the first edge and the second edge cooperating to define the opening, and closing the opening by attaching the first edge and the second edge together to define a seam.

The seam may be disposed in a forefoot region of the knitted component.

The method may include attaching a sole structure to upper, where attaching the sole structure includes covering at least a portion of the seam with the sole structure.

The method may include forming the first portion and the second portion at a different gauge knit structure. The first portion may be formed at a higher-gauge knit structure than the second portion.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

The following discussion and accompanying figures disclose a variety of concepts relating to methods of knitting knitted components. These knitted components can be incorporated in an article of footwear in some embodiments. As will be discussed, different areas of the knitted component can be knitted substantially simultaneously. In some embodiments, these different areas can be formed simultaneously despite being detached from each other. Furthermore, in some embodiments, the different areas can form opposing portions of the article of footwear. Also, in some embodiments, these different areas can overlay and/or overlap during formation. Moreover, the methods of the present disclosure can be used for incorporating at least one tensile element in knitted component. In some embodiments, the tensile element can be incorporated while other portions of the knitted component are knitted. Accordingly, the knitting methods of the present disclosure can increase manufacturing efficiency for the article of footwear.

Figure 1:
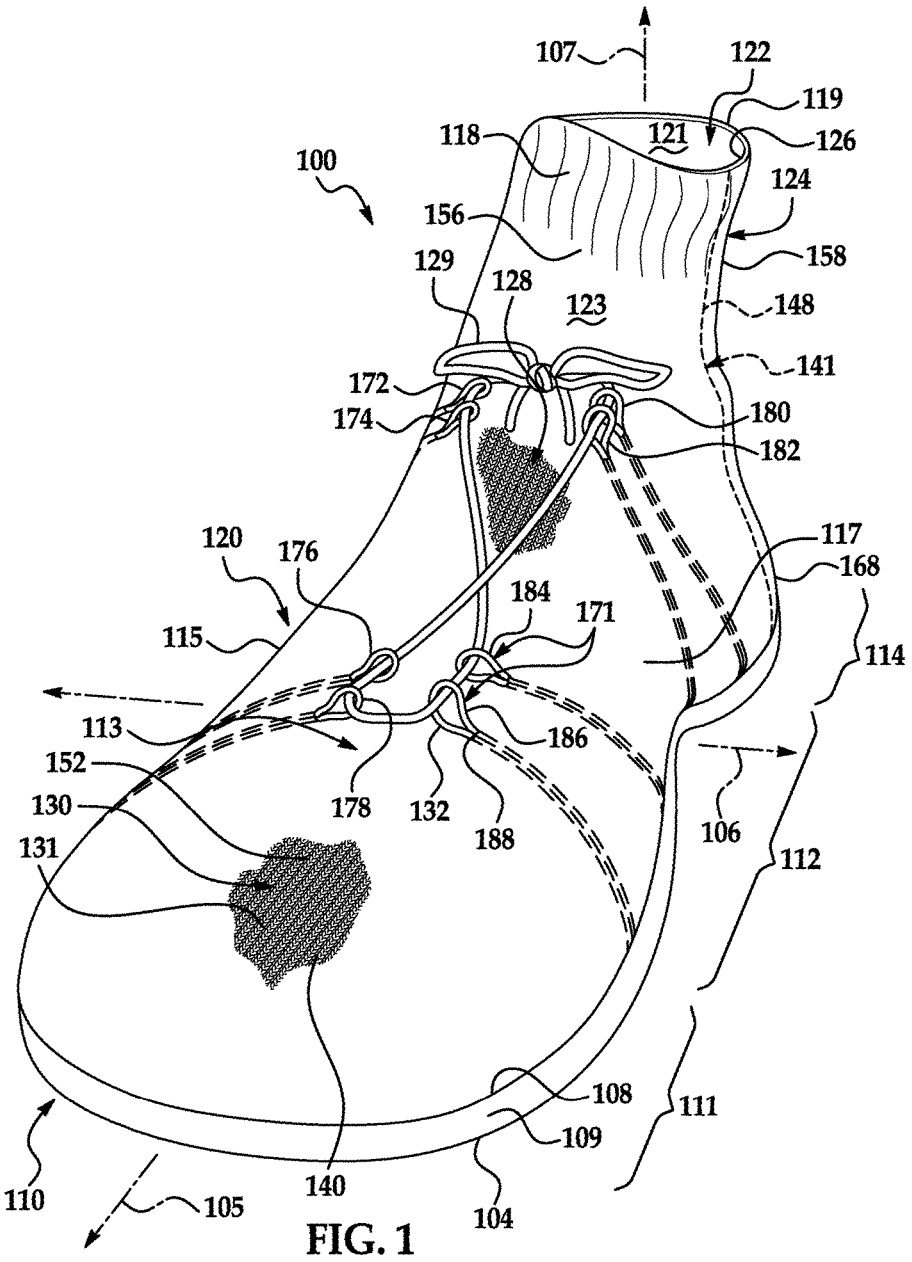
FIG. 1 is a front perspective view of an article of footwear according to exemplary embodiments of the present disclosure.

Referring initially to FIG. 1, an article of footwear 100 is illustrated according to exemplary embodiments. Generally, footwear 100 can include a sole structure 110 and an upper 120. Upper 120 can receive the wearer's foot and secure footwear 100 to the wearer's foot whereas sole structure 110 can extend underneath upper 120 and support wearer.

For reference purposes, footwear 100 may be divided into three general regions: a forefoot region 111, a midfoot region 112, and a heel region 114. Forefoot region 111 can generally include portions of footwear 100 corresponding with forward portions of the wearer's foot, including the toes and joints connecting the metatarsals with the phalanges. Midfoot region 112 can generally include portions of footwear 100 corresponding with middle portions of the wearer's foot, including an arch area. Heel region 114 can generally include portions of footwear 100 corresponding with rear portions of the wearer's foot, including the heel and calcaneus bone. Footwear 100 can also include first and second sides. More specifically, footwear 100 can include a lateral side 115 and a medial side 117. Lateral side 115 and medial side 117 can extend through forefoot region 111, midfoot region 112, and heel region 114 in some embodiments. Lateral side 115 and medial side 117 can correspond with opposite sides of footwear 100. More particularly, lateral side 115 can correspond with an outside area of the wearer's foot (i.e. the surface that faces away from the other foot), and medial side 117 can correspond with an inside area of the wearer's foot (i.e., the surface that faces toward the other foot). Forefoot region 111, midfoot region 112, heel region 114, lateral side 115, and medial side 117 are not intended to demarcate precise areas of footwear 100. Rather, forefoot region 111, midfoot region 112, heel region 114, lateral side 115, and medial side 117 are intended to represent general areas of footwear 100 to aid in the following discussion.

Footwear 100 can also extend along various axes. For example, as shown in FIG. 1, footwear 100 can extend along a longitudinal axis 105, a transverse axis 106, and a vertical axis 107. Longitudinal axis 105 can extend generally between heel region 114 and forefoot region 111. Transverse axis 106 can extend generally between lateral side 115 and medial side 117. Also, vertical axis 107 can extend substantially perpendicular to both longitudinal axis 105 and transverse axis 106. It will be appreciated that longitudinal axis 105, transverse axis 106, and vertical axis 107 are merely included for reference purposes and to aid in the following discussion.

Embodiments of sole structure 110 will now be discussed with reference to FIG. 1. Sole structure 110 can be secured to upper 120 and can extend between the wearer's foot and the ground when footwear 100 is worn. Sole structure 110 can be a uniform, one-piece member in some embodiments. Alternatively, sole structure 110 can include multiple components, such as an outsole, a midsole, and an insole, in some embodiments.

Also, sole structure 110 can include a ground-engaging surface 104. Ground-engaging surface 104 can also be referred to as a ground-contacting surface. Furthermore, sole structure 110 can include an upper surface 108 that faces the upper 120. Stated differently, upper surface 108 can face in an opposite direction from the ground-engaging surface 104. Upper surface 108 can be attached to upper 120. Also, sole structure 110 can include a side peripheral surface 109 that extends between ground engaging surface 104 and upper surface 108. Side peripheral surface 109 can extend generally along vertical axis 107. Side peripheral surface 109 can also extend substantially continuously about footwear 100 along forefoot region 111, lateral side 115, heel region 114, medial side 117 and back to forefoot region 111.

Embodiments of upper 120 will now be discussed in greater detail with reference to FIGS. 1-4. Upper 120 is shown attached to sole structure 110 in FIGS. 1 and 3, sole structure 110 is shown in phantom in FIG. 2, and sole structure 110 is hidden in FIG. 4.

As shown, upper 120 can define a cavity or void 122 that receives a foot of the wearer. Also, upper 120 can define an interior surface 121 that defines void 122, and upper 120 can define an exterior surface 123 that faces in a direction opposite interior surface 121. When the wearer's foot is received within void 122, upper 120 can at least partially enclose and encapsulate the wearer's foot. Thus, upper 120 can extend about forefoot region 111, lateral side 115, heel region 114, and medial side 117 in some embodiments.

Upper 120 can also include a collar 124. Collar 124 can include an ankle opening 126 that is configured to allow passage of the wearer's foot during insertion or removal of the foot from the void 122.

Upper 120 can also include a throat 128. Throat 128 can extend from ankle opening 126 toward forefoot region 111. Throat 128 dimensions can be varied to change the width of footwear 100 between lateral side 115 and medial side 117. Thus, throat 128 can affect fit and comfort of article of footwear 100.

Figure 2:
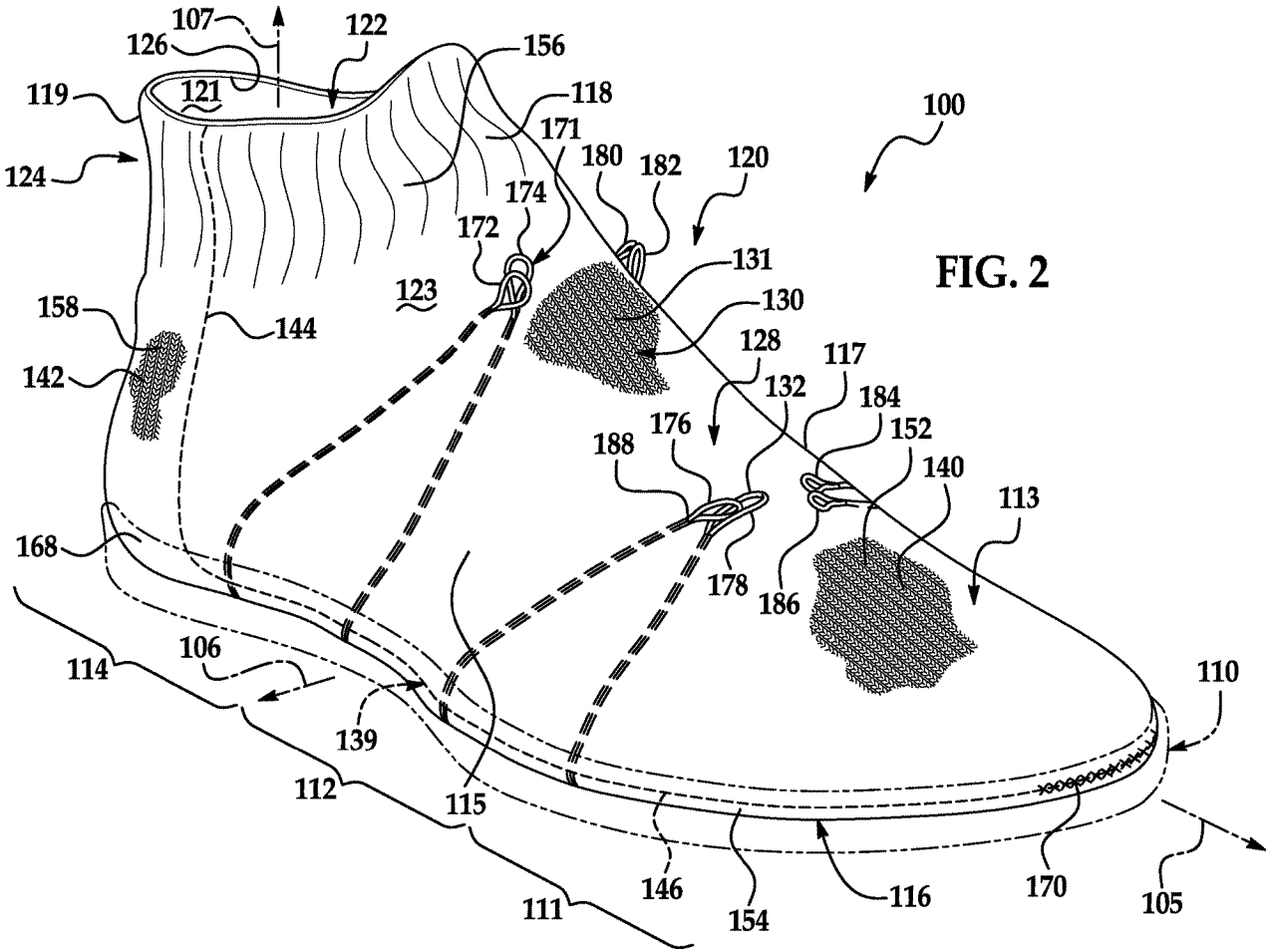
FIG. 2 is a lateral perspective view of the upper of the article of footwear of FIG. 1 with the sole structure shown in phantom.
Figure 3:
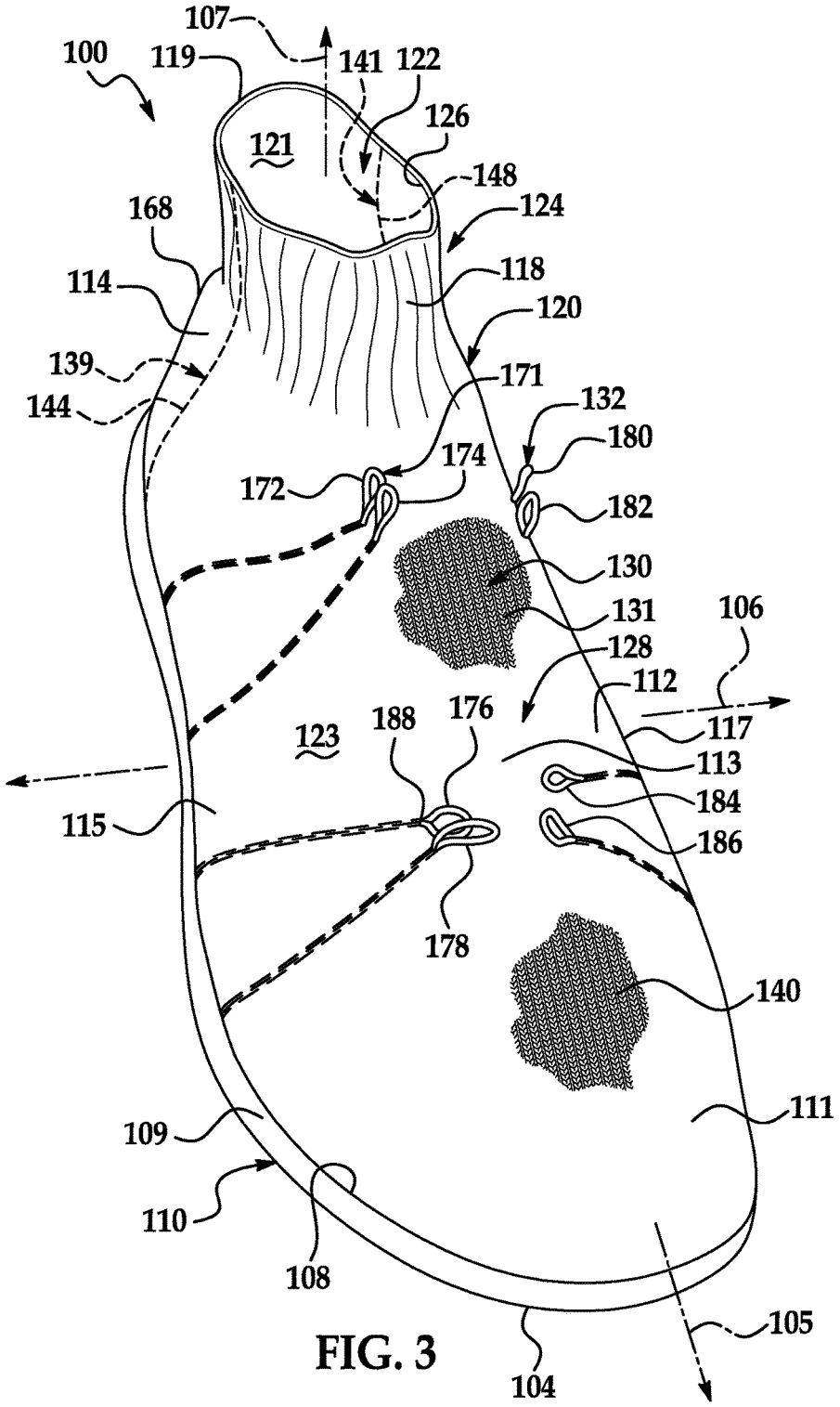
FIG. 3 is a top perspective view of the article of footwear of FIG. 1.

In some embodiments, such as the embodiment of FIGS. 1-3, throat 128 can be a "closed" throat 128, in which upper 120 is substantially continuous and uninterrupted between lateral side 115 and medial side 117. As such, upper 120 can be sock-like in some embodiments. In other embodiments, throat 128 can include a throat opening between lateral side 115 and medial side 117. In these latter embodiments, footwear 100 can include a tongue that is disposed within throat opening. For example, in some embodiments, the tongue can be attached at its forward end to forefoot region 111, and the tongue can be detached from lateral side 115 and lateral side 117. Accordingly, the tongue can substantially fill the throat opening. Furthermore, in some embodiments represented in FIG. 1, footwear 100 can include a securement device 129. Securement device 129 is hidden in FIGS. 2-4 for purposes of clarity. Securement device 129 can include one or more shoelaces, straps, buckles, or other members that can be used to selectively tighten or cinch the upper 120 onto the wearer's foot and, conversely, to loosen the upper 120 from the foot. In some embodiments, securement device 129 can extend across throat 128 and can be used for varying the width of upper 120.

Figure 4:
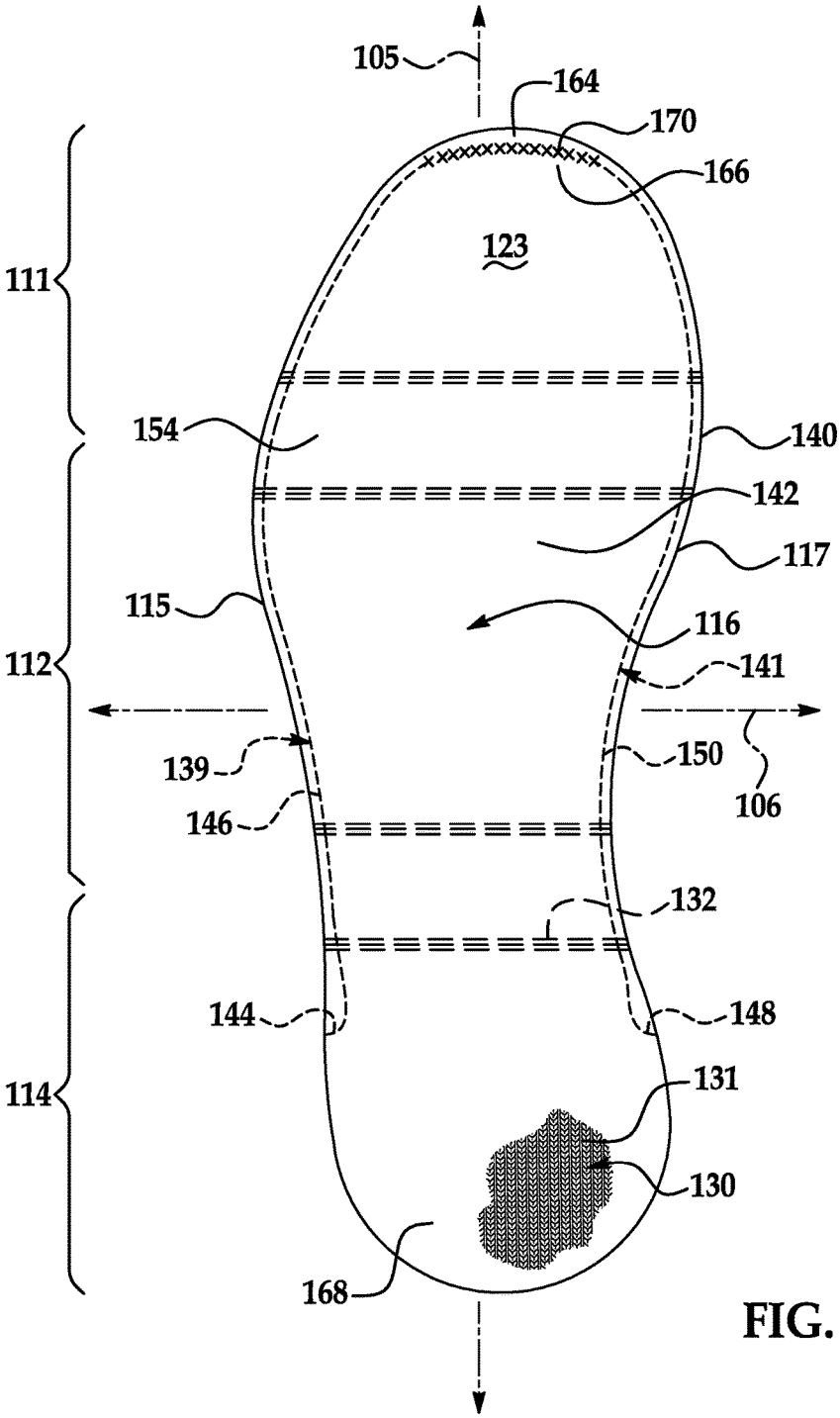
FIG. 4 is a bottom view of the article of footwear of FIG. 1 with the sole structure hidden.

As represented in the embodiments of FIGS. 1-4, upper 120 can span over the top and sides of the wearer's foot and about the wearer's lower leg. Other portions of upper 120 can span underneath the wearer's foot. More specifically, as shown in FIGS. 2 and 4, upper 120 can include an overfoot member 113 that extends upward from sole structure 110 and that generally spans over the top and sides of the wearer's foot and about the wearer's lower leg. As shown in FIGS. 2 and 4, upper 120 can also include an underfoot member 116 that is proximate sole structure 110 and that generally spans underneath the wearer's foot. In some embodiments, overfoot member 113 and underfoot member 116 can cooperate to define the void 122 within upper 120.

More specifically, in some embodiments, overfoot member 113 can include at least a portion of throat 128, lateral side 115, medial side 117, forefoot region 111, and at least part of heel region 114. Also, overfoot member 113 can form the so-called "vamp" of the footwear 100. In some embodiments represented in FIG. 1, overfoot member 113 can comprise those areas of upper 120 that extend upward and away from sole structure 110 to be exposed from sole structure 110.

Additionally, in some embodiments, underfoot member 116 can be attached to sole structure 110 in some embodiments. For example, underfoot member 116 can be layered over sole structure 110 in some embodiments. Furthermore, underfoot member 116 can be at least partially hidden and covered over by sole structure 110 in some embodiments. Additionally, it will be appreciated that at least a portion of underfoot member 116 can be referred to as a "strobel," a "strobel sock," a "strobel part," or a "strobel member."

Upper 120 can be formed from a variety of materials and using a variety of manufacturing techniques. For example, many conventional footwear uppers are formed from multiple material elements (e.g., polymer foam, polymer sheets, leather, synthetic leather) that are joined together through stitching or bonding, for example. However, in various embodiments discussed herein, upper 120 can be at least partially formed from a textile or fabric component. For example, upper 120 can be made at least partially through a knitting process, such as a flat knitting process. In other embodiments, the upper can be formed via weaving. As such, upper can be lightweight, breathable, and soft to the touch. However, the fabric can be constructed such that upper is durable and strong. Moreover, the knitting or weaving processes can provide manufacturing efficiencies and can result in a relatively low amount of waste. Also, the fabric can provide resiliency and stretchability to the upper. For example, the fabric can have some degree of stretchiness due to the knitted or woven construction. Furthermore, in some embodiments, the fabric can be knitted or woven from elastic and stretchable yarns, which further enhance the stretchiness of the upper.

More specifically, in some embodiments, upper 120 can include a knitted component 130 that at least partially defines upper 120. For example, as shown in the embodiments illustrated, knitted component 130 can define a majority of upper 120. As such, knitted component 130 can extend through forefoot region 111, midfoot region 112, and/or heel region 114. Knitted component 130 can also extend along lateral side 115, medial side 117, forefoot region 111, and heel region 114. Furthermore, portions of knitted component 130 can define overfoot member 113, and other portions can define underfoot member 116 of upper 120. Moreover, in some embodiments, knitted component 130 can extend circumferentially around the wearer's heel, ankle and/or lower leg. As such, knitted component 130 can substantially encapsulate the wearer's foot in some embodiments.

In addition, in some embodiments, knitted component 130 can define exterior surface 123 and/or interior surface 121 of upper 120. In other embodiments, a skin layer or other object can be layered over and attached to knitted component 130 such that the skin layer defines the exterior surface 123 and/or the interior surface 121 of upper 120.

Knitted component 130 can provide upper 120 with weight savings as compared with other conventional uppers. Furthermore, knitted component 130 can be elastic and stretchable in some embodiments. Thus, knitted component 130 can stretch out to allow passage of the wearer's foot into and out of void 122 within footwear 100. Furthermore, when footwear 100 is worn, upper 120 can lightly compress and conform against the wearer's foot for added comfort and support. Additionally, knitted component 130 can provide the upper 120 with useful features, such as three-dimensionally curved areas, projections, and recessed areas. Still further, knitted component 130 can be formed using efficient methods. These methods can increase manufacturing efficiency for footwear 100. Also, these methods can reduce the part count for the upper 120 and further increase manufacturing efficiency.

Moreover, knitted component 130 can be formed of unitary knit construction. As defined herein and as used in the claims, the term "unitary knit construction" means that knitted component 130 is formed as a one-piece element through a knitting process. That is, the knitting process substantially forms the various features and structures of knitted component 130 without the need for significant additional manufacturing steps or processes. A unitary knit construction may be used to form a knitted component having structures or elements that include one or more courses of yarn or other knit material that are joined such that the structures or elements include at least one course in common (i.e., sharing a common strand or common yarn) and/or include courses that are substantially continuous between each portion of knitted component 130. With this arrangement, a one-piece element of unitary knit construction is provided.

Although portions of knitted component 130 may be joined to each other following the knitting process, knitted component 130 remains formed of unitary knit construction because it is formed as a one-piece knit element. As an example, knitted component 130 can be formed of unitary knit construction and can include opposing edges that are joined at a seam to form upper 120. Moreover, knitted component 130 can remain formed of unitary knit construction when other elements (e.g., a tensile element, a closure element, logos, trademarks, placards with care instructions and material information, and other structural elements) are added following the knitting process.

Thus, upper 120 can be constructed with a relatively low number of material elements. This can decrease waste while also increasing the manufacturing efficiency and recyclability of upper 120. Additionally, knitted component 130 of upper 120 can incorporate a smaller number of seams or other discontinuities. This can further increase manufacturing efficiency of footwear 100.

In different embodiments, any suitable knitting process may be used to produce knitted component 130 formed of unitary knit construction, including, but not limited to a flat knitting process, such as warp knitting, weft knitting, or any other knitting process suitable for providing a knitted component. Examples of various configurations of knitted components and methods for forming knitted component 130 with unitary knit construction are disclosed in U.S. Pat. No. 6,931,762 to Dua; and U.S. Pat. No. 7,347,011 to Dua, et al., the disclosure of each being incorporated by reference in its entirety.

Embodiments of Knitted Component

With reference to FIGS. 1-10, knitted component 130 will be discussed in greater detail according to exemplary embodiments. Knitted component 130 can generally include a knit element 131 and at least one tensile element 132. Knit element 131 can define a majority of knitted component 130 in some embodiments. Also, tensile element 132 can be incorporated within and formed of unitary knit construction with knit element 131. For example, in some embodiments, represented in FIG. 10, tensile element 132 can be inlaid within one or more courses or wales of knit element 131 during the knitting process such that tensile element 132 and knit element 131 are formed of unitary knit construction. Tensile element 132 can provide stretch resistance to respective areas of knitted component 130. It will be appreciated that tensile elements 132 can be included in any suitable area of knitted component 130. In some embodiments, knitted component 130, knit element 131, and/or tensile elements 132 can incorporate the teachings of one or more of commonly-owned U.S. patent application Ser. No. 12/338,726 to Dua et al., entitled "Article of Footwear Having An Upper Incorporating A Knitted Component", filed on Dec. 18, 2008 and published as U.S. Patent Application Publication Number 2010/0154256 on Jun. 24, 2010, and U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012, both of which applications are hereby incorporated by reference in their entirety.

Knit element 131 of knitted component 130 may be formed from at least one yarn, cable, fiber, or other strand that is manipulated (e.g., with a knitting machine) to form a plurality of intermeshed and interconnected loops that define a plurality of courses and wales. Yarn(s) that form knit element 131 can be of any suitable type. For example, yarn of knit element 131 can be made from cotton, elastane, rayon, wool, nylon, polyester, or other material. Also, in some embodiments, one or more areas of knit element 131 can be made from yarn that is elastic and resilient. As such, the yarn can be stretched in length from a first length, and yarn can be biased to recover to its first length. Thus, such an elastic yarn can allow corresponding areas of knit element 131 to stretch elastically and resiliently under the influence of a force. When that force is reduced, knit element 131 can recover back its neutral position.

Furthermore, in some embodiments, one or more yarns of knit element 131 can be at least partially formed from a thermoset polymer material that can melt when heated and that can return to a solid state when cooled. As such, the yarn can be a fusible yarn and can be used to join two objects or elements together. In additional embodiments, knit element 131 can include a combination of fusible and non-fusible yarns. In some embodiments, for example, knitted component 130 and upper 120 can be constructed according to the teachings of U.S. Patent Publication No. 2012/0233882, which published on Sep. 20, 2012, and the disclosure of which is hereby incorporated by reference in its entirety.

Moreover, tensile element 132 can be of any suitable type of strand, yarn, cable, cord, filament (e.g., a monofilament), thread, rope, webbing, or chain, for example. In comparison with the yarns of knit element 131, the thickness of tensile element 132 may be greater. Although the cross-sectional shape of tensile element 132 may be round, triangular, square, rectangular, elliptical, or irregular shapes may also be utilized. Moreover, the materials forming tensile element 132 may include any of the materials for the yarn of knit element 131, such as cotton, elastane, polyester, rayon, wool, and nylon. As noted above, tensile element 132 may exhibit greater stretch-resistance than knit element 131. As such, suitable materials for tensile element 132 may include a variety of engineering filaments that are utilized for high tensile strength applications, including glass, aramids (e.g., para-aramid and meta-aramid), ultra-high molecular weight polyethylene, and liquid crystal polymer. As another example, a braided polyester thread may also be utilized as tensile element 132.

Tensile element 132 and other portions of knitted component 130 can additionally incorporate the teachings of one or more of commonly-owned U.S. patent application Ser. No. 12/338,726 to Dua et al., entitled "Article of Footwear Having An Upper Incorporating A Knitted Component", filed on Dec. 18, 2008 and published as U.S. Patent Application Publication Number 2010/0154256 on Jun. 24, 2010; U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012; U.S. patent application Ser. No. 13/781,336 to Podhajny, entitled "Method of Knitting A Knitted Component with a Vertically Inlaid Tensile Element", filed on Feb. 28, 2013 and published as U.S. Patent Publication No. 2014/0237861 on Aug. 28, 2014, each of which is hereby incorporated by reference in its entirety.

Embodiments of Knit Element

Referring now to FIGS. 6-9, knit element 131 will be discussed in greater detail according to exemplary embodiments. In these figures, knit element 131 is shown in a substantially flattened state with lateral side 115 layered over medial side 117.

In some embodiments, knit element 131 can form a hollow tubular structure with a first end 137 and a second end 138. In some embodiments, first end 137 can be open to define ankle opening 126 of upper 120. Additionally, second end 138 can define forefoot region 111 of upper 120. As will be discussed, second end 138 can be open when knit element 131 is formed as represented in FIGS. 6-9; however, second end 138 can be subsequently closed in some embodiments.

Knit element 131 can also include an outer surface 164 and an inner surface 162. Knit element 131 is shown with outer surface 164 revealed in FIGS. 6 and 7, and knit element 131 is shown inside-out to reveal inner surface 162 in FIGS. 8 and 9. In some embodiments, outer surface 164 can substantially define exterior surface 123 of upper 120, and inner surface 162 can substantially define interior surface 121 of upper 120. In other embodiments, an object, such as a skin layer, can be attached to inner surface 162 and/or outer surface 164.

Moreover, knit element 131 can generally include a first portion 140 and a second portion 142. In some embodiments, a majority of first portion 140 can be configured to extend over the wearer's foot and in front of the wearer's ankle and/or shin. Also, in some embodiments, a majority of second portion 142 can be configured to extend underneath the wearer's foot and behind the wearer's ankle and/or shin. Thus, first portion 140 and second portion 142 can include corresponding areas that oppose each other.

More specifically, first portion 140 can generally include a forward area 152 and a front heel area 156. Forward area 152 can be generally disposed in forefoot region 111 and midfoot region 112, and front heel area 156 can be substantially disposed in heel region 114. In some embodiments, forward area 152 of first portion 140 can be configured to extend over the wearer's foot within forefoot region 111 and midfoot region 112, and front heel area 156 can be substantially configured to be disposed in front of the wearer's ankle and/or shin within heel region 114.

Also, second portion 142 of knit element 131 can generally include a forward area 154 and a rear heel area 158. Forward area 154 can be generally disposed in forefoot region 111 and midfoot region 112, and rear heel area 158 can be substantially disposed in heel region 114. In some embodiments, forward area 154 of second portion 142 can be configured to extend underneath the wearer's foot within forefoot region 111 and midfoot region 112, and rear heel area 158 can be substantially configured to be disposed in back of the wearer's ankle and/or shin. Also, in some embodiments, second portion 142 can include a heel cup 168. Heel cup 168 can be concave and three-dimensionally curved. Accordingly, heel cup 168 can be configured to receive the heel of the wearer's foot. Also, heel cup 168 can be disposed at a transition between forward area 154 and rear heel area 158 of second portion 142.

Moreover, in some embodiments, first portion 140 and second portion 142 can cooperate to define the opening at the first end 137 of knit element 131. Stated differently, first portion 140 can include a first edge 160, second portion 142 can include a first edge 162, and first edge 160 and first edge 162 can cooperate to define the opening at first end 137 of knit element 131. Likewise, in some embodiments, first portion 140 and second portion 142 can cooperate to define the opening at the second end 138 of knit element 131. Stated differently, first portion 140 can include a second edge 164, second portion 142 can include a second edge 166, and second edge 164 and second edge 166 can cooperate to define the opening at second end 138 of knit element 131.

Predetermined areas of first portion 140 can be joined to predetermined areas of second portion 142. In some embodiments, first portion 140 and second portion 142 can be joined and formed of unitary knit construction with each other. For example, first portion 140 and second portion 142 can be attached at a first joined area 139 and a second joined area 141. First joined area 139 and second joined area 139 are indicated in FIGS. 6-9 with respective broken lines. Accordingly, it will be appreciated that first joined area 139 can form a first boundary between first portion 140 and second portion 142 of knit element 131. Likewise, it will be appreciated that second joined area 141 can form a second boundary between first portion 140 and second portion 142.

First joined area 139 can be located primarily on lateral side 115 of knit element 131 in some embodiments. Also, second joined area 141 can be located primarily on medial side 117 of knit element 131. In some embodiments, first joined area 139 and second joined area 141 can both extend continuously from first end 137 of knit element 131 to second end 138 of knit element 131. However, it will be appreciated that first portion 140 and second portion 142 can be joined at any portion of knit element 131.

Figure 6:
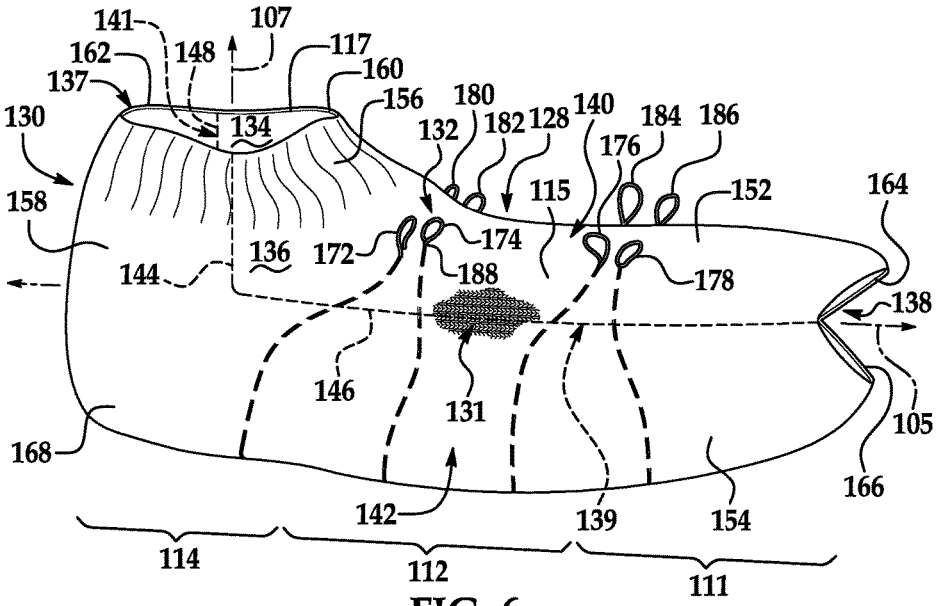
FIG. 6 is a lateral plan view of a knitted component of the article of footwear of FIG. 1.

More specifically, as shown in the embodiment of FIG. 6, first joined area 139 can be subdivided into a first segment 144 and a second segment 146. First segment 144 can extend from first end 137 of knit element 131 substantially along the vertical axis 107 within heel region 114 to join front heel area 156 and rear heel area 158 on lateral side 115. Second segment 146 can extend continuously from first segment 144 and substantially along the longitudinal axis 105 within midfoot region 112 and forefoot region 111 to join forward area 152 and forward area 154 on lateral side 115. Also, second segment 146 can terminate at second end 138 of knit element 131.

Figure 7:
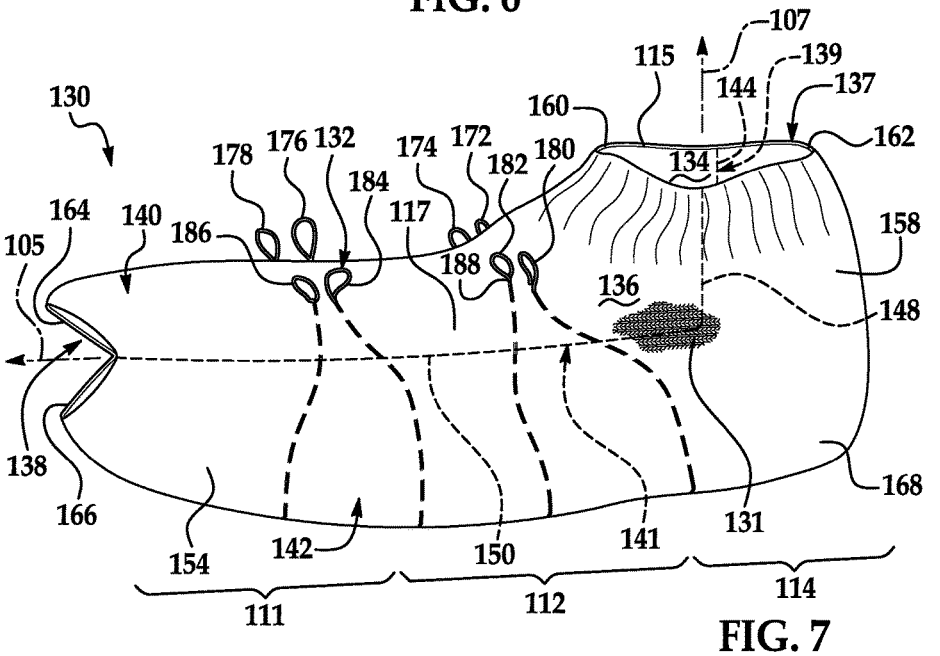
FIG. 7 is a medial plan view of the knitted component of FIG. 6.

Additionally, as shown in the embodiment of FIG. 7, second joined area 141 can be subdivided into a first segment 148 and a second segment 150. First segment 148 can extend from first end 137 of knit element 131 substantially along the vertical axis 107 within heel region 114 to join front heel area 156 and rear heel area 158 on medial side 117. Second segment 150 can extend continuously from first segment 148 and substantially along the longitudinal axis 105 within midfoot region 112 and forefoot region 111 to join forward area 152 and forward area 154 on medial side 117. Also, second segment 150 can terminate at second end 138 of knit element 131.

In some embodiments, second edge 164 of first portion 140 and second edge 166 of second portion 142 can be attached to each other to close off the second end 138 of knit element 131 and to define a seam 170 as shown in FIGS. 2 and 4. Seam 170 can be formed via adhesives, fasteners, needle and thread, or other attachment devices. Thus, in some embodiments, seam 170 can be formed after knit element 131 is knitted.

Accordingly, as shown in the illustrated embodiments, knit element 131 can define a majority of upper 120. Also, when knit element 131 is assembled, forward area 152 of first portion 140 can define the majority of overfoot member 113 of upper 120. Accordingly, in some embodiments, knit element 131 can define forefoot region 111 of upper 120 as well as a majority of lateral side 115, throat 128, and medial side 117 of upper 120 within midfoot region 112. Furthermore, forward area 154 of second portion 142 of knit element 131 can define a majority of underfoot member 116 of upper 120. Additionally, front heel area 156 and rear heel area 158 of knit element 131 can cooperate to define heel region 114 of upper 120.

Additionally, in some embodiments, portions of knit element 131 can have different characteristics than other portions of knit element 131. For example, in some embodiments, different portions can be substantially smooth, while other areas can be textured to include ribbing, projections, and/or recesses. Furthermore, in some embodiments, different portions of knit element 131 can have different elasticities and stretchability. Additionally, in some embodiments, different portions of knit element 131 can be knit with different yarns. In some embodiments, different portions of knit element 131 can be knit at different gauges. Moreover, in some embodiments, portions can be mesh-like while other portions can have a more continuous knit structure.

Embodiments of Tensile Element

As mentioned above, knitted component 130 can include at least one tensile element 132 that is coupled to knit element 131. In some embodiments, knitted component 130 can include a single tensile element 132. In other embodiments, knitted component 130 can include a plurality of tensile elements 132. Tensile element 132 can be formed of unitary knit construction with knit element 131 in some embodiments.

Tensile element 132 can incorporate the teachings of one or more of commonly-owned U.S. patent application Ser. No. 12/338,726 to Dua et al., entitled "Article of Footwear Having An Upper Incorporating A Knitted Component", filed on Dec. 18, 2008 and published as U.S. Patent Application Publication Number 2010/0154256 on Jun. 24, 2010, and U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012, both of which applications are hereby incorporated by reference in their entirety.

Tensile element 132 can be elongate and flexible in bending. As such, tensile element 132 may be formed from any generally one-dimensional material that may be utilized in a knitting machine or other device that forms knitted component 130. As utilized with respect to the present disclosure, the term "one-dimensional material" or variants thereof is intended to encompass generally elongate materials exhibiting a length that is substantially greater than a width and a thickness. Accordingly, suitable materials for tensile element 132 include various filaments, fibers, and yarns, that are formed from rayon, nylon, polyester, polyacrylic, silk, cotton, carbon, glass, aramids (e.g., para-aramid fibers and meta-aramid fibers), ultra-high molecular weight polyethylene, and liquid crystal polymer. In addition to filaments and yarns, other one-dimensional materials may be utilized for tensile element 132. Although one-dimensional materials will often have a cross-section where width and thickness are substantially equal (e.g., a round or square cross-section), some one-dimensional materials may have a width that is somewhat greater than a thickness (e.g., a rectangular, oval, or otherwise elongate cross-section). Despite the greater width, a material may be considered one-dimensional if a length of the material is substantially greater than a width and a thickness of the material.

Also, an individual filament utilized in tensile element 132 may be formed form a single material (i.e., a monocomponent filament) or from multiple materials (i.e., a bicomponent filament). Similarly, different filaments may be formed from different materials. As an example, tensile element 132 may include filaments that are each formed from a common material, may include filaments that are each formed from two or more different materials, or may include filaments that are each formed from two or more different materials. Similar concepts also apply to threads, cables, ropes, etc. The thickness (diameter) of tensile element 132 can be within a range from approximately 0.03 millimeters to 5 millimeters, for example. Also, tensile element 132 can have a substantially circular cross section, an ovate cross section, or a cross section of any other suitable shape.

As an example, tensile element 132 may be formed from a bonded nylon 6.6 with a breaking or tensile strength of 3.1 kilograms and a weight of 45 tex. Tensile element 132 can also be formed from a bonded nylon 6.6 with a breaking or tensile strength of 6.2 kilograms and a tex of 45. As a further example, the tensile element 132 may have an outer sheath that sheathes and protects an inner core.

In some embodiments, tensile element 132 can have a substantially fixed length (e.g., can be nonextendible). As such, knitted component 130 can resist stretching at areas that include tensile element 132.

Tensile element 132 can be incorporated in knitted component 130 in a variety of ways without departing from the scope of the present disclosure. For example, in some embodiments represented in FIG. 10, tensile element 132 can be inlaid within at least one course or wale of knit element 131 to be formed of unitary knit construction with knit element 131. In other embodiments, tensile element 132 can be adhered, fastened, pierced through, or otherwise coupled to knit element 131. Additionally, tensile element 132 can be routed across portions of knit element 131, for example, to provide stretch resistance to those portions.

Tensile element 132 can extend across knit element 131 in a predetermined route. For example, in some embodiments, tensile element 132 can extend generally along the lateral side 115 and/or medial side 117 of knit element 131. Tensile element 132 can also extend underneath the wearer's foot in some embodiments.

Also, in some embodiments, tensile element 132 can extend across both first portion 140 and second portion 142 of knit element 131. For example, tensile element 131 can extend across first portion 140 on lateral side 115 and medial side 117. Also, tensile element 131 can extend across second portion 142 as tensile strand 131 extends between lateral side 115 and medial side 117. Furthermore, segments of tensile element 132 can be disposed proximate areas of first portion 140 that define throat 128 of upper 120. Additionally, in some embodiments, tensile element 132 can extend back-and-forth repeatedly between lateral side 115 and medial side 117 of knit element 131.

Moreover, in some embodiments, tensile element 132 can extend continuously between first portion 140 and second portion 142 of knit element 131. Stated differently, tensile element 132 can extend continuously across first joined area 139 and/or second joined area 141 as tensile element 132 extends between first portion 140 and second portion 142.

Additionally, in some embodiments, tensile element 132 can turn to form a loop 171 or loop-like structure. In some embodiments, tensile element 132 can include a plurality of loops 171. Loop 171 in tensile element 132 can be a receiving element that receives the shoelace or other securement device 129 as illustrated in FIG. 1. In some embodiments represented in FIG. 1, loop 171 can be exposed from knit element 131. In other embodiments, loop 171 can be embedded within knit element 131. Also, in some embodiments, the knit element, 131 can include an aperture, such as an eyelet, and the aperture and loop 171 in the tensile element 132 can align to cooperatively receive the shoelace or other securement device 129.

Specifically, in some embodiments, tensile element 132 can form first lateral loop 172, a second lateral loop 174, a third lateral loop 176, and a fourth lateral loop 178, first medial loop 180, a second medial loop 182, a third medial loop 184, and a fourth medial loop 186. Each of these loops can receive the shoe lace or other securement device 129.

Figure 5:
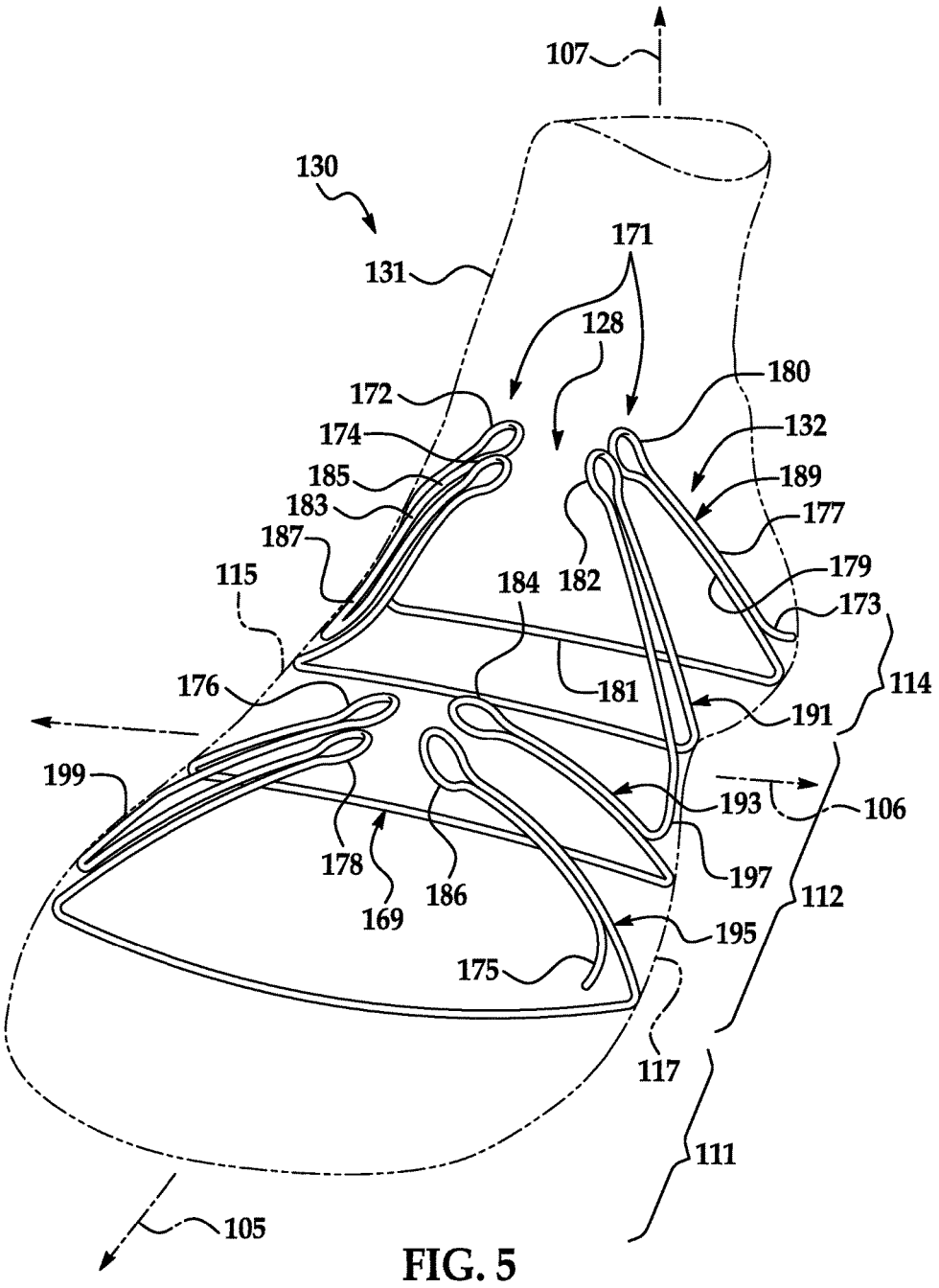
FIG. 5 is a perspective view of a tensile element of the article of footwear of FIG. 1.

Moreover, as shown in the embodiments represented in FIG. 5, knitted component 130 can include a single tensile element 132 that has a first end 173 and a second end 175. In some embodiments, first end 173 and second end 175 can be disposed on a common side (e.g., the medial side 117) of the knit element 131. First end 173 can be disposed in heel region 114 and second end 175 can be disposed in forefoot region 111 in some embodiments.

Tensile element 132 can also include an intermediate portion 169 that extends between the first end 173 and the second end 175. Intermediate portion 169 can be subdivided into a plurality of segments that extend across different portions of knit element 131.

For example, as shown in FIGS. 5-9, a first medial vertical segment 177 can extend upward from first end 173 toward throat 128. First medial loop 180 can extend from first medial vertical segment 177. First medial loop 180 can be disposed on a rear, medial side of the throat 128. A second medial vertical segment 179 can extend downward from first medial loop 180. Also, tensile strand 132 can include a first underfoot segment 181 that extends from medial side 117 toward lateral side 115. Furthermore, tensile strand 132 can include a first lateral vertical segment 183 that extends upward from first underfoot segment 181. Tensile strand 132 can additionally form first lateral loop 172 proximate lateral side of throat 128. A second lateral vertical segment 185 can extend downward from first lateral loop 172.

Figure 8:
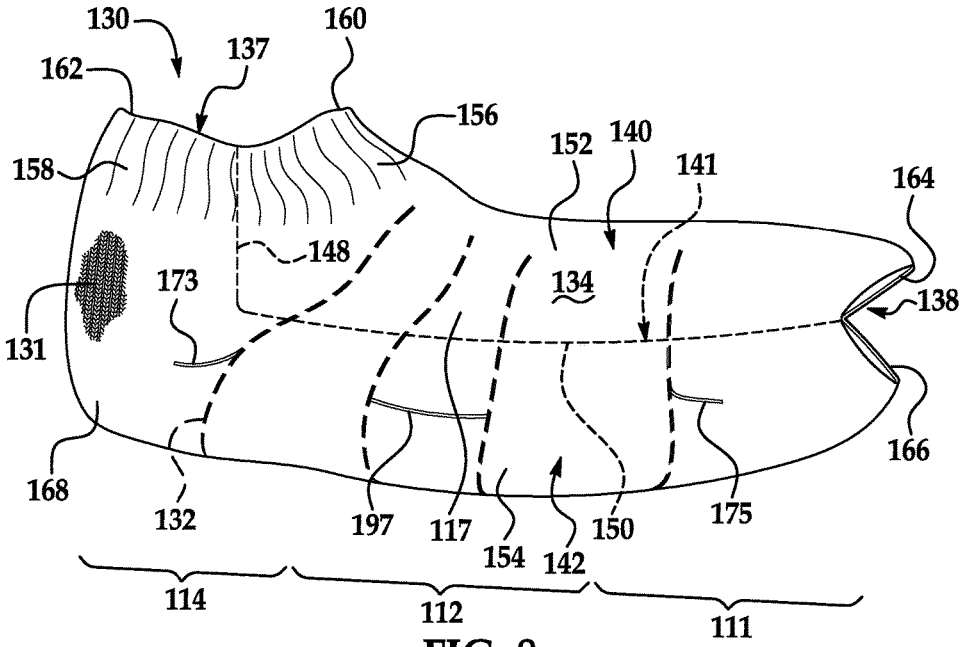
FIG. 8 is a medial plan view of the knitted component of FIG. 6 shown inside-out.
Figure 9:
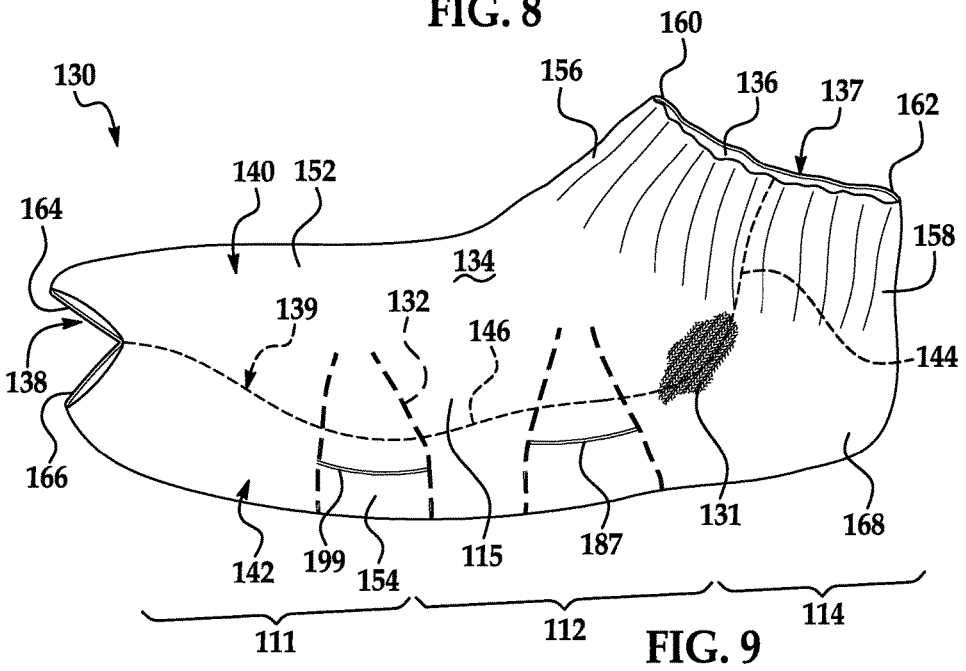
FIG. 9 is a lateral plan view of the knitted component of FIG. 6 shown inside-out.

First medial vertical segment 177, second medial vertical segment 179, first medial loop 180, first underfoot segment 181, first lateral vertical segment 183, first lateral loop 172, and second lateral vertical segment 185 can together form a first cradle structure 189 that extends about the wearer's foot within heel region 114. Tensile strand 132 can be routed repeatedly in this pattern generally along longitudinal axis 105 of knitted component 130 to additionally form a second cradle structure 191, a third cradle structure 193, and a fourth cradle structure 195. Second cradle structure 191 and third cradle structure 193 can be disposed substantially within midfoot region 112, and fourth cradle structure 195 can be disposed within forefoot region 111. As shown in FIGS. 5, 8 and 9, tensile strand 132 can further include a first lateral horizontal segment 187 that extends between first cradle structure 189 and second cradle structure 191. Tensile strand 132 can additionally include a medial horizontal segment 197 that extends between second cradle structure 191 and third cradle structure 193. Furthermore, tensile strand 132 can include a second lateral horizontal segment 199 that extends between third cradle structure 193 and fourth cradle structure 195.

As mentioned above, tensile element 132 can be inlaid within knit element 131. As such, tensile element 132 can be received in one or more passages 188, which are defined by knit element 131, as shown in FIGS. 6-10. Passage 188 can be generally disposed between the interior surface 121 and the exterior surface 123 of the knit element 131. In some embodiments, passage 188 can be defined through one or more courses or wales of the knit element 131.

Figure 10:
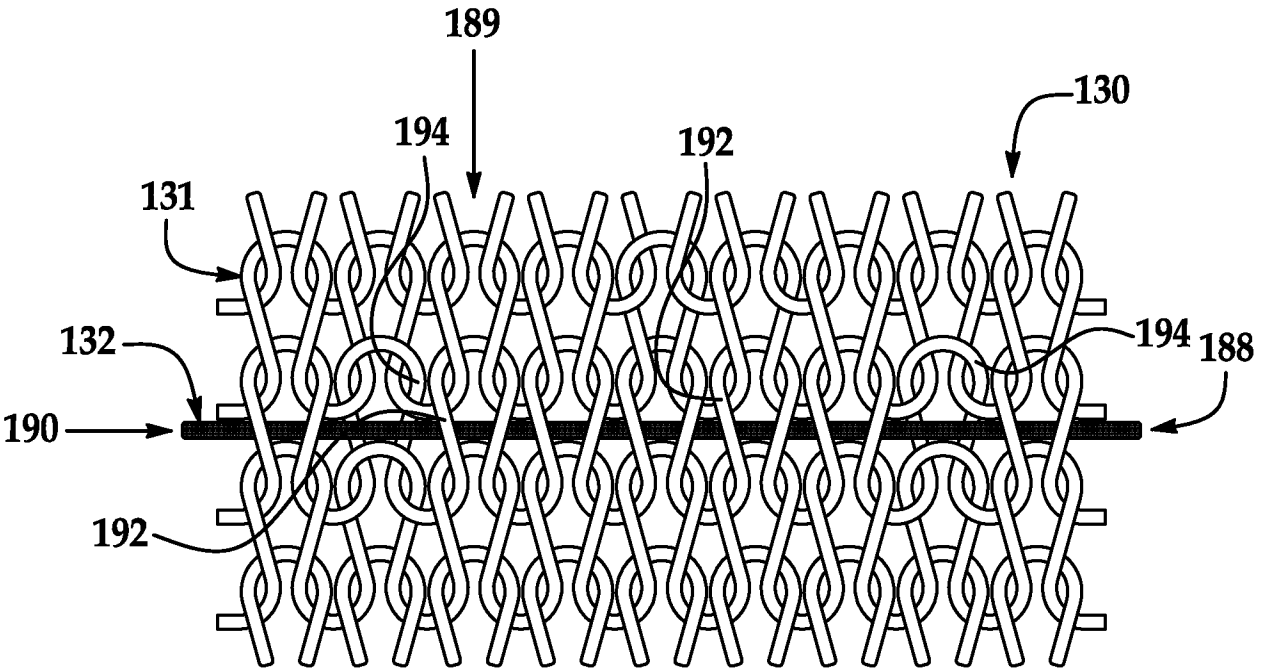
FIG. 10 is a detail view of the knitted component.

In some embodiments, interconnected knit loops can define both interior surface 121 and opposing areas of exterior surface 123 of knit element 131. In these embodiments, passage 188 can be formed by loops that are spaced apart from each other within the same course and that are opposite each other. For example, as shown in FIG. 10, tensile element 132 can extend through a knitted course 190. Course 190 can include one or more front loops 192 that are disposed in front of tensile element 132 and other back loops 194 that are disposed in back of tensile element 132. As such, front loops 192 and back loops 194 can cooperate to retain tensile element 132 to knit element 131.

It will be appreciated that the course 190 can have any desired spacing and arrangement of front loops 192 and back loops 194 for retaining tensile element 132. It will also be appreciated that tensile element 132 can be inlaid within knit element 131 and can extend along one or more wales 189 of knit element 131.

It will be appreciated that tensile element 132 can be configured to provide support for various areas of the wearer's foot. For example, tensile element 132 can support the bottom as well as the sides of the wearer's foot. Also, in some embodiments, tensile element 132 can be disposed proximate an arch region of the wearer's foot for supporting the arch. Also, the tensile element 132 can cradle the foot for improved support. Also, by tensioning tensile element 132, upper 120 can closely conform and fit knitted component 130 to the wearer's foot.

Embodiments of Methods of Knitting a Knitted Component

Referring now to FIGS. 11-19, methods of knitting knitted component 130 will be discussed in detail. As will be discussed, in some embodiments, the knitting methods can be used to form multiple corresponding portions of knitted component 130 in a substantially simultaneous manner. For example, in some embodiments, a portion of knitted component 130 configured to fit over the wearer's foot can be knitted at substantially the same time as a corresponding portion configured to span underneath the wearer's foot. Thus, opposing portions of knitted component 130 can be formed substantially simultaneously.

Stated differently, as knitted component 130 is being knitted, the corresponding portions can grow away from the needle beds of a knitting machine. Knitted courses can be added to the different corresponding portions, causing this fabric growth. As such, a first knitted course of one portion can be added as a second knitted course of a corresponding portion is added.

Additionally, specific methods can be employed for utilizing a knitting machine, such as a flat knitting machine, to form the corresponding portions substantially simultaneously. These methods can increase efficiency, reduce waste, and allow knitted component 130 to be formed more inexpensively.

In some embodiments, knitted component 130, upper 120, and article of footwear 100 can be formed according to one or more teachings of U.S. Provisional Patent Application No. 62/104,190, filed Jan. 16, 2015, which is hereby incorporated by reference in its entirety.

Figure 11:
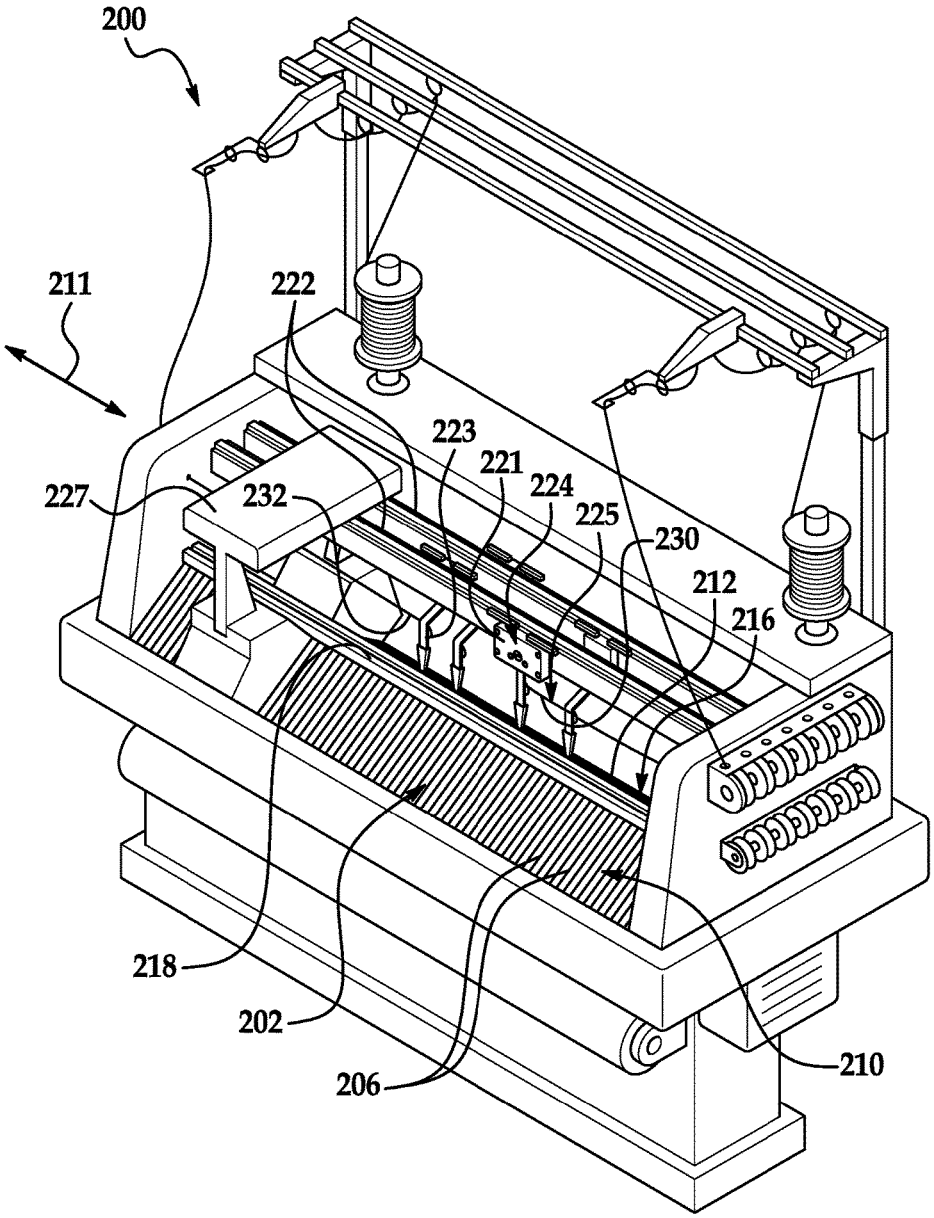
FIG. 11 is a perspective view of a knitting machine configured for knitting the knitted component of FIG. 6.

Referring initially to FIG. 11, an exemplary knitting machine 200 suitable for forming knitted component 130 is illustrated. Knitting machine 200 can be of any suitable type, such as a flat knitting machine, a circular knitting machine, or other type. For example, knitting machine 200 can have a configuration of a V-bed flat knitting machine in some embodiments. However, the knitting machine 200 used for forming knitted component 130 can have different configurations without departing from the scope of the present disclosure.

Knitting machine 200 can include a plurality of needles 202, which are illustrated schematically in FIG. 11. Needles 202 can include a plurality of first needles 206 and a plurality of second needles 212. First needles 206 can be arranged generally in a first bed 210 of knitting machine 200. In some embodiments, first bed 210 can be substantially planar. Similarly, second needles 212 can be arranged in a second bed 216, which can be substantially planar in some embodiments. It will be appreciated that first bed 210 can be referred to as a "front bed," and second bed 216 can be referred to as a "rear bed."

First bed 210 and/or second bed 216 can extend along a relatively straight longitudinal axis 211. Furthermore, first bed 210 and second bed 216 can be spaced apart from each other as shown in FIG. 10 to define a gap 218 between first and second beds 210, 216. Also, first bed 210 and second bed 216 can be disposed at an angle relative to each other.

Knitting machine 200 can further include one or more rails 222. Rails 222 can be elongate and can extend substantially parallel to the longitudinal axis 211. Rails 222 can provide attachment points for one or more yarn feeders 224.

Feeders 224 can move longitudinally along the respective rail 222 while feeding yarn 225 toward needles 202. It will be appreciated that feeders 224 can be configured to feed any type of yarn, fiber, wire, cable, filament, or other strand toward needles 202. Additionally, feeders 224 and other features of knitting machine 200 can be configured according to the teachings of U.S. Pat. No. 8,522,577, which issued on Sep. 3, 2013, and which is incorporated by reference in its entirety.

Needles 202 can receive yarn 225 and can perform various knitting procedures for incorporating yarn 225 into knitted component 130. For example, needles 202 can knit, tuck, float, inlay, or otherwise manipulate yarn 225 to form knitted component 130.

In some embodiments, feeders 224 can include a first feeder 221 and a second feeder 223, which are used in combination to form knitted component 130. In some embodiments, first feeder 221 can feed a first yarn 230 toward first needle bed 210 and/or second needle bed 216. Second feeder 223 can feed a second yarn 232 toward first needle bed 210 and/or second needle bed 216. However, it will be appreciated that knitted component 130 can be at least partially knitted using a single feeder 224 and/or using a single yarn 225 in some embodiments. Moreover, it will be appreciated that knitted component 130 can be at least partially knitted using more than two feeders 224 and/or using more than two yarns 225 in some embodiments.

First and second feeders 221, 223 can be attached to and supported by a common rail 222. In some embodiments, first feeder 221 can be attached to a front side of rail 222 and second feeder 223 can be attached to a rear side of rail 222. Both first and second feeders 221, 223 can be actuated along rail 222 by a carriage 227. As such, first and second feeders 221, 223 can slide back-and-forth along rail 222, parallel to the longitudinal axis 211.

Figure 12:
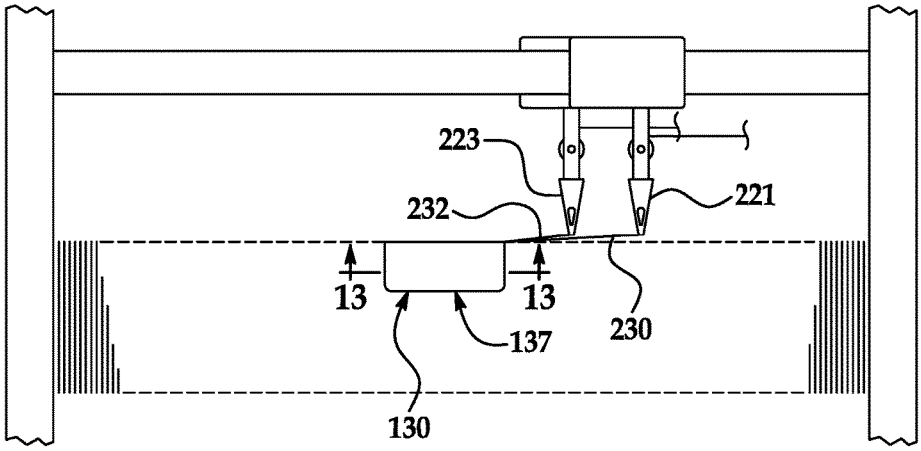
FIG. 12 is a schematic view of the knitting machine in the process of knitting the knitted component of FIG. 6.
Figure 13:
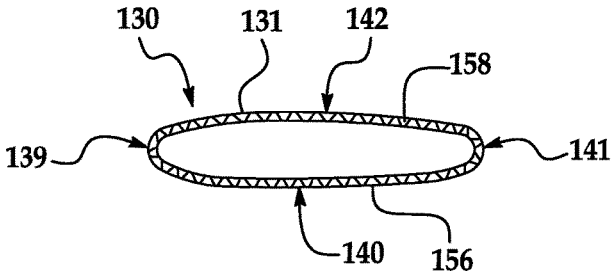
FIG. 13 is a cross section of the knitted component taken along the line 13-13 of FIG. 12.

FIGS. 12-17 are schematic illustrations of the process of knitting knitted component 130 according to exemplary embodiments. Generally, in some embodiments, first feeder 221 and second feeder 223 can respectively feed first yarn 230 and second yarn 232 toward needles 202 as shown in FIG. 12. As such, needles 202 can knit first portion 140 and the opposing second portion 142 of knit element 131. In some embodiments, first portion 140 and second portion 142 can be knit substantially simultaneously. Additionally, in some embodiments, first feeder 221 can be used to form first portion 140 with first yarn 230, and second feeder 223 can be used to form second portion 142 with second yarn 232. These feeders 221, 223 can be operated in tandem to simultaneously interconnect and interloop knitted courses to previously knit courses. Also, during the knitting process, first portion 140 and second portion 142 can be joined together at first joined area 139 and second joined area 141 such that knit element 131 has a hollow, tubular structure as discussed above.

Figure 14:
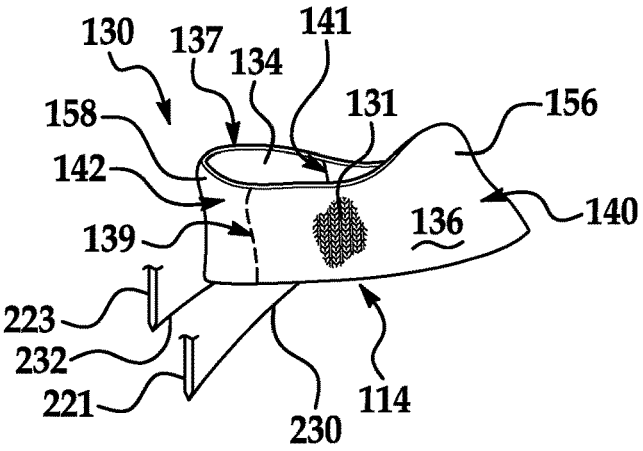
FIG. 14 is a schematic illustration of the process of knitting a heel region of the knitted component of FIG. 6.

In some embodiments represented in FIGS. 12 and 14, first end 137 of knitted component 130 can be formed initially during the knitting method. Specifically, the hollow, tubular structure of first end 137 can be defined by forming front heel area 156 and rear heel area 158 of knit element 131 substantially simultaneously. Front heel area 156 and rear heel area 158 can also be joined by interconnected knit loops at first joined area 139 and second joined area 141 during this process.

Figure 15:
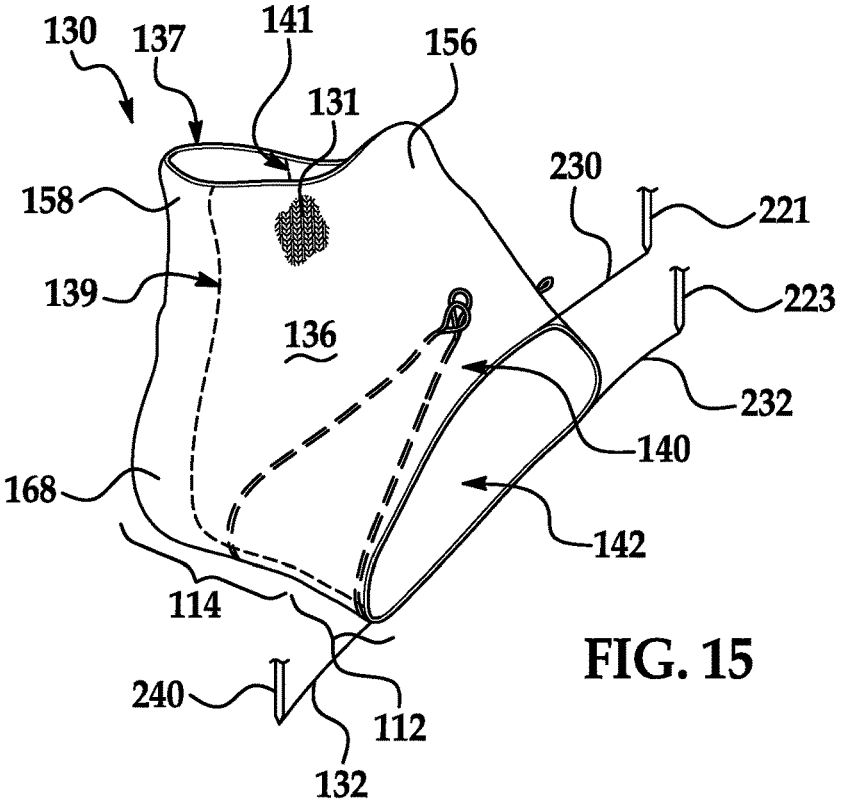
FIG. 15 is a schematic illustration of the process of knitting a midfoot region of the knitted component of FIG. 6.
Figure 16:
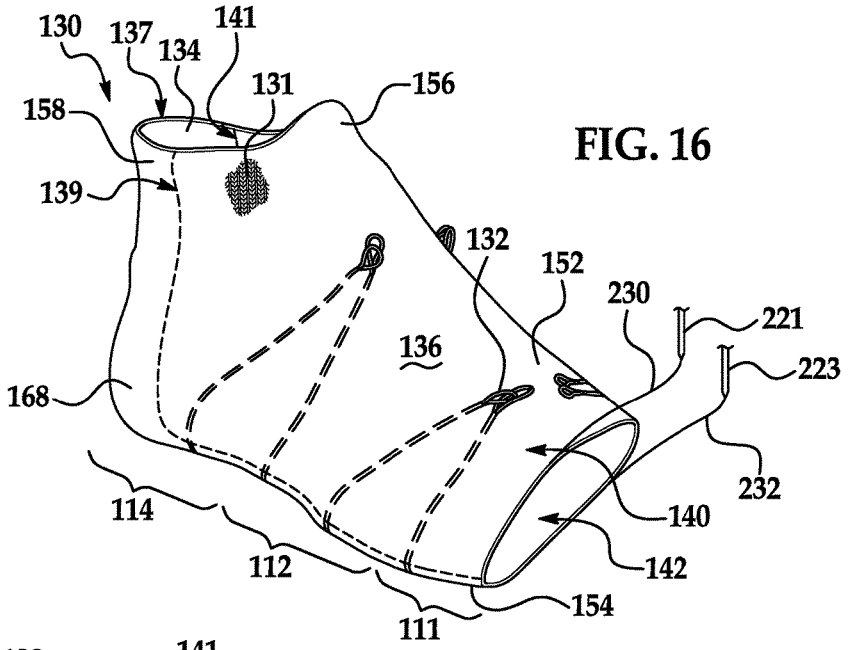
FIG. 16 is a schematic illustration of the process of knitting a forefoot region of the knitted component of FIG. 6.

Knitted courses can be subsequently added to and interlooped with previously knit courses as represented in FIGS. 15 and 16. Thus, as shown, forward area 152 of first portion 140 can be formed substantially simultaneously with forward area 154 of second portion 140. This process can continue until second end 138 of knitted component 130 is formed. As mentioned above, second end 138 can include edge 164 and edge 166 when knitted component 130 is initially formed.

The opposing portions of first portion 140 that correspond to second portion 142 can be knitted in a variety of ways. As stated, the feeders 221, 223 can perform a substantially synchronous pass of needles 202, feeding yarns 230, 232 and forming respective courses in some embodiments. As a result, first needles 206 and second needles 212 can form respective courses during the pass and, in some embodiments, interloop the courses together at the joined areas 139, 141.

Figure 18:
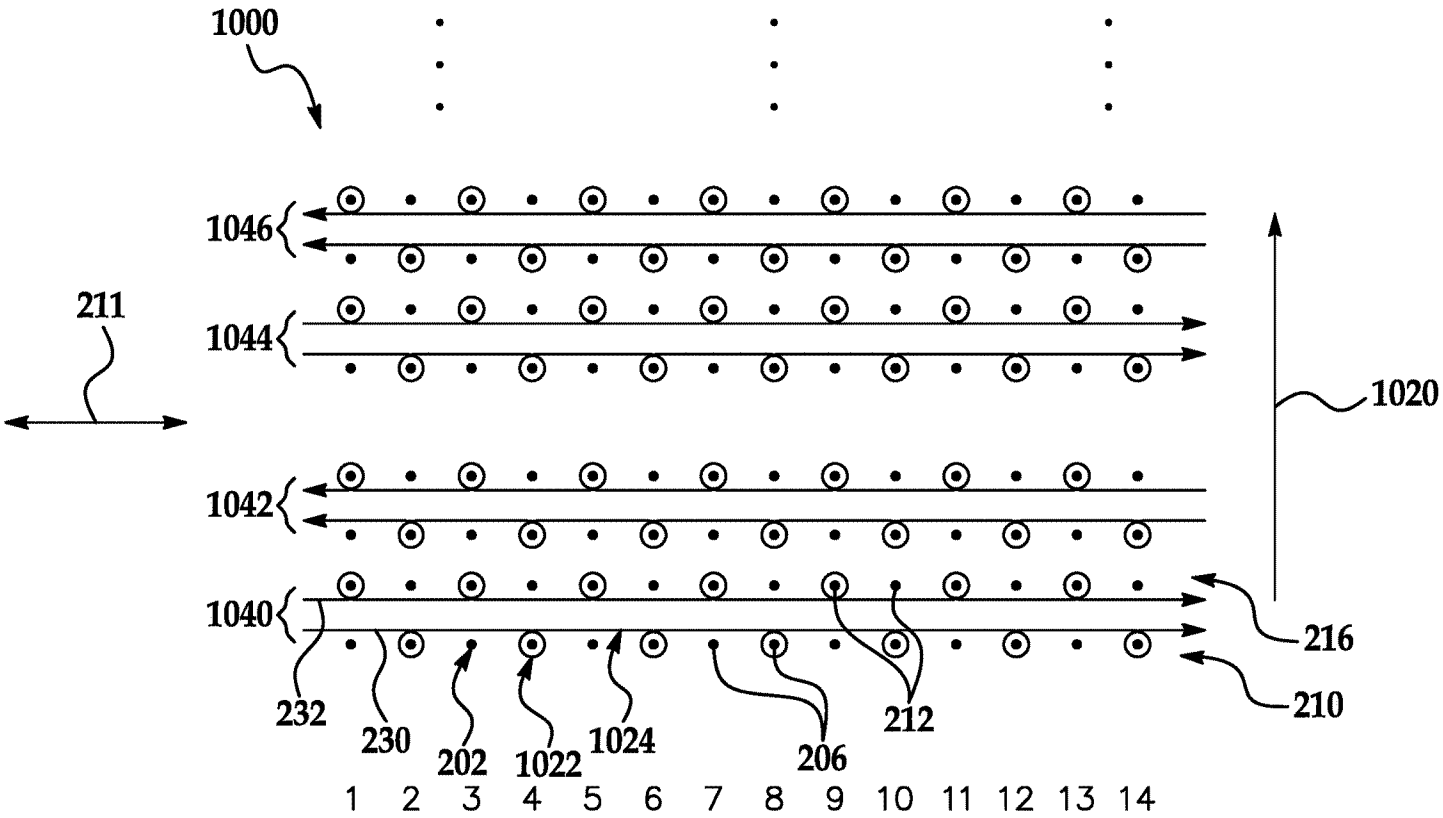
FIG. 18 is a diagram illustrating a method of knitting the knitted component of FIG. 6 according to exemplary embodiments.
Figure 19:
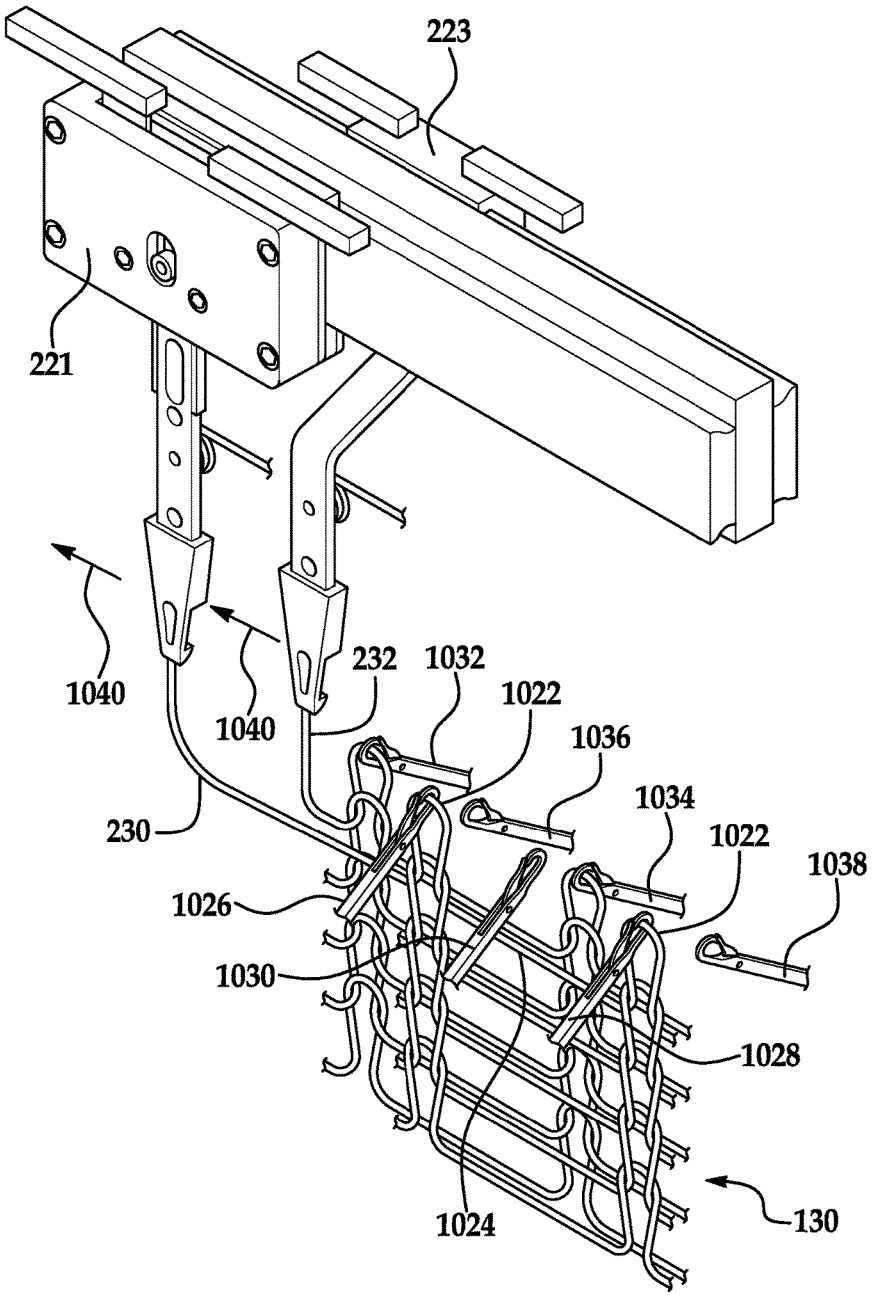
FIG. 19 is a schematic illustration of a portion of the knitting machine of FIG. 11 shown during the knitting method of FIG. 18.

More specifically, FIG. 18 is an exemplary diagram illustrating a method 1000 of knitting first and second portions 140, 142 substantially simultaneously according to exemplary embodiments. FIG. 19 corresponds to FIG. 18 and shows portions of the knitting machine and the knitting process according to some embodiments.

These embodiments of method 1000 can be employed for simultaneously forming forward areas 152, 154 of knit element 131 in some embodiments. Also, in some embodiments, these embodiments can be employed for simultaneously forming front heel areas 156, 158 of knit element 131. It will be appreciated that FIG. 18 represents needles 202 with dots that are aligned horizontally in rows. Positions of the needles 202 are indicated at the bottom of the page with numbers 1 through 14 for reference purposes. It will be appreciated that the needles 202 in positions 1 through 14 can represent first needles 206 of the first bed 210 of the knitting machine 200 as well as second needles 212 of the second bed 216. It will also be appreciated that needles 202 in positions 1 through 14 can be representative of other needles 202 within beds 210, 216.

Knit element 131 can grow in a fabric growth direction, which is indicated with an upwardly pointed arrow 1020 in FIG. 18. Yarns 230, 232 are also indicated with elongate lines extending primarily along the horizontal direction.

As shown in FIGS. 18 and 19, first yarn 230 and second yarn 232 can be fed toward needles 202, and predetermined ones of the needles 202 can form loops 1022 that interlock with previously-formed loops 1022 to form knitted component 130. Also, in some embodiments, floats 1024 can be formed at predetermined needle locations. Stated differently, floats 1024 can be formed between predetermined pairs of loops 1022. These knit structures and the method of creating the structures can allow the opposing portions of knitted component 130 to be knit substantially simultaneously.

In some embodiments, needles 202 of both first bed 210 and second bed 216 can be used to knit separate and opposing portions of knitted component 130. As such, opposing sides of the knitted component 130 can be knitted substantially simultaneously. More specifically, in some embodiments, first needles 206 of first bed 210 can be used to knit an area of first portion 140 of knit element 131. Also, second needles 212 of second bed 216 can be used to knit an opposing area of second portion 142 of knit element 131.

For example, to form first portion 140 in some embodiments, first feeder 221 can feed first yarn 230 toward first needles 206 of first bed 210 in a first pass 1040 along the needle beds 210, 216. First pass 1040 is directed to the right hand side of the page in FIG. 18 as an example. A predetermined group of the first needles 206 can receive first yarn 230 and form loops 1022. Also, in this pass 1040 of first feeder 221, first feeder 221 can bypass or skip others of the first needles 206 and create floats 1024 at those locations. Specifically, in some embodiments represented in FIG. 18, loops 1022 can be formed at needle positions 2, 4, 6, 8, 10, 12, and 14, and floats 1024 can be formed at needle positions 1, 3, 5, 7, 9, 11, and 13. This is further illustrated in FIG. 19, wherein loops 1022 are formed using a first active front needle 1026 and a second active front needle 1028, and wherein a float 1024 is formed proximate a first empty front needle 1030.

Also, to form second portion 142 in some embodiments, second feeder 223 can feed second yarn 232 toward second needles 212 of second bed 216 in the same pass 1040 along the needle beds 210, 216. A predetermined group of the second needles 212 can receive second yarn 232 and form loops 1022. Also, in this pass 1040 of second feeder 223, second feeder 223 can bypass or skip others of the second needles 212 and create floats 1024 at those locations. For example, as shown in FIG. 18, loops 1022 can be formed at needle positions 1, 3, 5, 7, 9, 11, and 13, and floats 1024 can be formed at needle positions 2, 4, 6, 8, 10, 12, and 14. This is further illustrated in FIG. 19, wherein loops 1022 are formed using a first active rear needle 1032 and a second active rear needle 1034, and wherein a float 1024 is formed proximate a first empty rear needle 1036 and a second empty rear needle 1038.

In some embodiments, first and second feeders 221, 223 can move substantially in synchronization and in the same direction during first pass 1040 as first and second portions 140, 142 of knitted component 130 are formed. However, as shown in FIG. 19, one of the first and second feeders 221, 223 can lag the other during the first pass 1040. Moreover, it will be appreciated that first feeder 221 and second feeder 223 can move in opposite directions during first pass 1040 without departing from the scope of the present disclosure. In these embodiments, loops 1022 of first portion 148 and loops 1022 of second portion 158 are added substantially simultaneously, albeit in an opposite direction. More specifically, the position of the knitted course added to the first portion 148 in the first pass 1040 can correspond to the position of the knitted course added to the second portion 158.

Next, as shown in FIG. 18, additional courses of loops 1022 and floats 1024 can be added to first and second portions 140, 142 of knit element 131 in a second pass 1042.

In some embodiments, first feeder 221 and second feeder 223 can move in the same direction with respect to needle beds 210, 216 during the second pass 104 during the second pass 1042. In the embodiment of FIG. 18, for example, second pass 1042 is directed to the left hand side of the page.

Subsequently, as shown in FIG. 18, additional courses of loops 1022 and floats 1024 can be added to first and second portions 140, 142 of knit element 131 in a third pass 1044. Third pass 1044 can be substantially similar to first pass 1040. Then, additional courses of loops 1022 and floats 1024 can be added to first and second portions 140, 142 of knit element 131 in a fourth pass 1046. Fourth pass 1046 can be substantially similar to second pass 1042. Thus, the passes illustrated in FIG. 18 can be repeated as necessary to form knit element 131.

Figure 20:
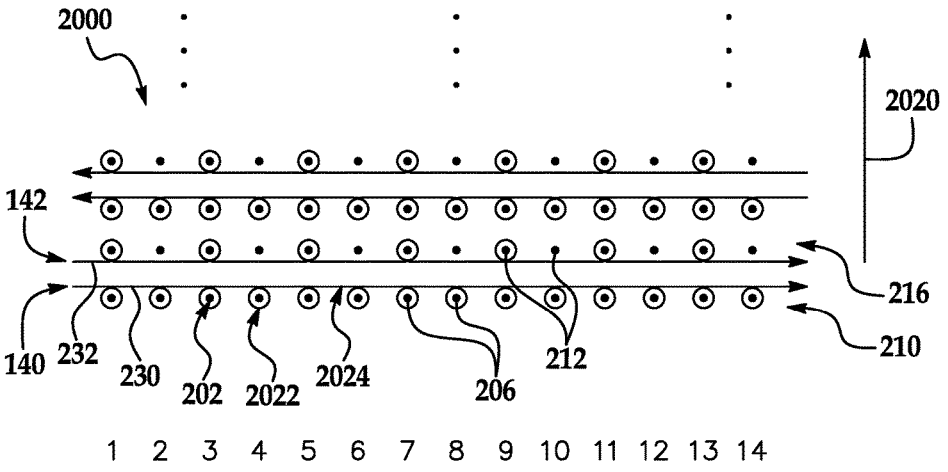
FIG. 20 is a diagram illustrating a method of knitting the knitted component according to additional exemplary embodiments.

FIG. 20 illustrates the knitting method 2000 according to additional embodiments. Method 2000 can be similar to FIGS. 18 and 19 except as noted. Reference numbers that correspond to those of FIGS. 18 and 19 are increased by 1000.

As shown, first portion 140 and second portion 142 can be knit at different gauges. For example, in the embodiment of FIG. 20, first portion 140 can be knit at a higher gauge knit structure than second portion 142. Specifically, as shown in FIG. 20, first portion 140 can be knit at every needle 206 to form a full-gauge jersey knit structure, while second portion 142 can be knit at every other needle 212 to form a half-gauge jersey knit structure.

In some embodiments, this structure can provide first portion 140 and second portion 142 with different properties. For example, in some embodiments, the lower-gauge knit structure of second portion 142 can cause second portion 142 to pull or bias first portion 140 downward toward sole structure 110 and/or underneath the wearer's foot. Thus, upper 120 can be more likely to secure the wearer's foot against the sole structure 110. Also, in some embodiments, second portion 142 can bias first portion 140 downward such that joined areas 139 of knit element 131 are more likely to be covered and concealed by sole structure 110.

Moreover, the knitted structure can vary from the embodiment of FIG. 20. For example, in some embodiment, first portion 140 can be a lower-gauge knit structure than second portion 142. In some embodiments, this knit structure can provide increased airflow and breathe-ability for first portion 140. Also, this knit structure can provide a greater amount of surface area for attachment of second area 142 to sole structure 110.

Figure 21:
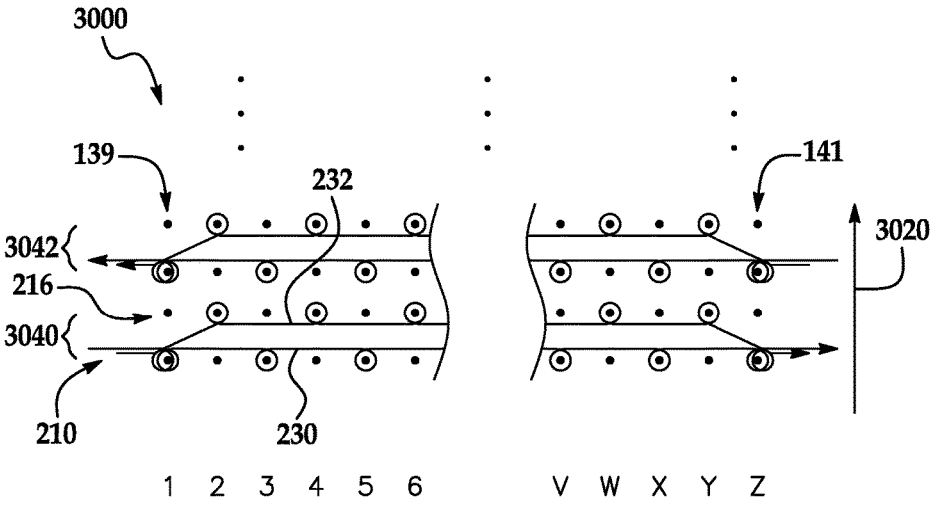
FIG. 21 is a diagram illustrating a method of knitting the knitted component according to additional exemplary embodiments.

Referring now to FIG. 21, an additional embodiment of the knitting method 3000 is illustrated. Method 3000 can be similar to the method of FIGS. 18 and 19 except as noted. Reference numbers that correspond to those of FIGS. 18 and 19 are increased by 2000.

As shown, in some embodiments, first portion 140 and second portion 142 can be joined at joined areas 139, proximate the ends of the first pass 3040 and at the ends of the second pass 3042. Specifically, in some embodiments, first yarn 230 can be fed and knit using first needle bed 210 to form first portion 140 of knit element. Also, second yarn 232 can be interlooped with first yarn 230 in the first needle bed 210 at needle location 1 during the first pass 3040. Thereafter, second yarn 232 can be knit using second needle bed 216 to form second portion 142 until second yarn 232 is interlooped with first yarn 230 in the first needle bed 210 at needle location Z. This process can be substantially repeated in second pass 3042 as well as in additional passes. Accordingly, first portion 140 and second portion 142 can be joined at first joined area 139 and second joined area 141.

Moreover, as shown in FIG. 21, the courses of first portion 140 and the courses of second portion 142 can have different lengths. For example, in some embodiments, the courses of first portion 140 can be longer than the courses of second portion 142. As such, second portion 142 can be layered substantially flat over the sole structure 110 and the first portion 140 can exhibit more loft and curvature relative to sole structure 110 to accommodate the foot. Moreover, because the courses of second portion 142 are shorter than those of first portion 140, the joined areas 139, 141 can be disposed closer and covered by sole structure 110.

It will be appreciated that a significant number of courses of first portion 140 of knit element 131 can correspond with courses of second portion 142. In some embodiments, however, one portion can include "extra courses" that do not directly correspond with courses of the other portion. For example, second portion 142 can include extra courses that define the three-dimensionally curved, concave heel cup 168. For example, second feeder 223 can feed second yarn 232 to form these extra courses in heel cup 168. Also, in some embodiments, first portion 140 can include extra courses that provide three-dimensional curvature in forefoot region 111.

While knit element 131 is formed and the number of knitted courses and wales increases, tensile element 132 can be inlaid within those courses/wales using knitting machine 200. For example, as shown in FIG. 15, as knit element 131 is formed, tensile element 132 can be inlaid. In some embodiments, tensile element 132 can be inlaid using an inlay feeder 240. Inlay feeder 240 can incorporate teachings of U.S. Pat. No. 8,522,577, issued Sep. 3, 2013, the disclosure of which is incorporated by reference in its entirety.

In some embodiments, segments of tensile element 132 that are proximate its first end 173 can be inlaid initially, and as more courses of knit element 131 are added, tensile element 132 can be further inlaid as discussed above. Specifically, as explained above with respect to FIG. 10, the tensile element 132 can be inlaid within a course or courses with a number of front loops 192 and a number of back loops 194 formed to secure tensile element 132 to knit element 131. Accordingly, tensile element 132 can be formed of unitary knit construction with knit element 131 in an efficient manner.

It will be appreciated that the knitting process can be altered from the illustrated embodiments without departing from the scope of the present disclosure. For example, in additional embodiments, knitted component 130 can be knitted such that second end 138 of knitted component 130 is formed first and first end 137 is formed last. Also, in the embodiments illustrated in FIGS. 12-17, knitted component 130 is shown being knitted such that the outer surface 136 is facing outward. However, it will be appreciated that knitted component 130 can be knitted with inner surface 134 facing outward (i.e., inside-out) without departing from the scope of the present disclosure. In this latter embodiment, once knitted component 130 is formed, knitted component 130 can be inverted (i.e., turned right-side-out) before subsequent processing of knitted component 130.

Figure 17:
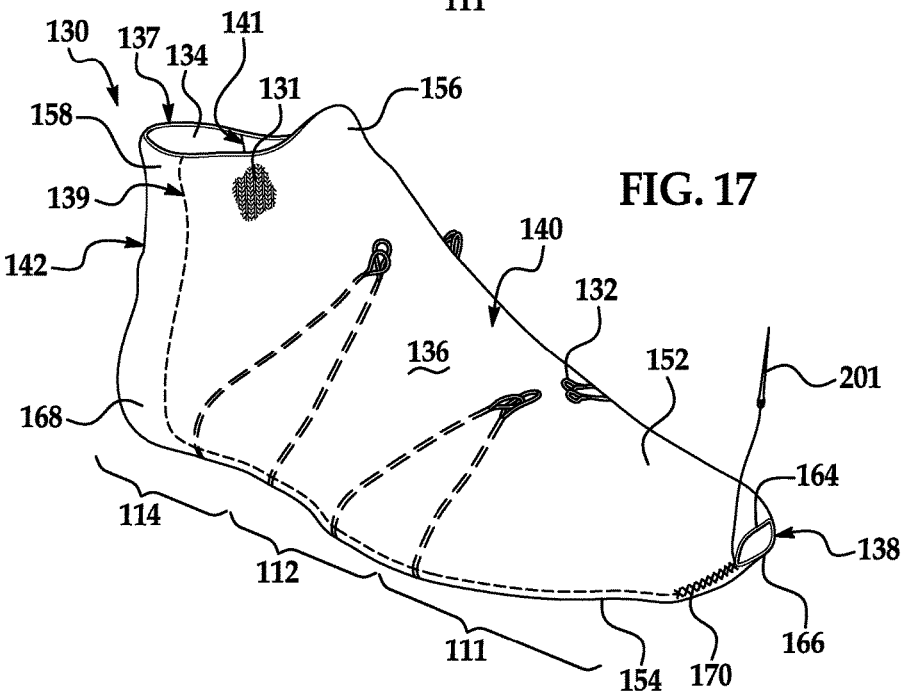
FIG. 17 is a schematic illustration of forming a seam in the forefoot region of the knitted component of FIG. 6.

Once second end 138 of knit element 131 has been formed, second end 138 can be closed off as represented in FIG. 17. Specifically, second edge 164 of first portion 140 and second edge 166 of second portion 142 can be attached together at seam 170 to close off second end 138. In some embodiments, a needle 201 and thread 203, such as those included on a sewing machine, can be used to form seam 170. In other embodiments, second edge 164 and second edge 166 can be joined at seam 170 using adhesives, fasteners, or other implements.

Sole structure 110 can then be attached to knitted component 131, for example, by adhesives. FIG. 1 shows an embodiment of sole structure 110 attached to knitted component 130. In some embodiments, sole structure 110 can overlay seam 170, second segment 146 of first joined area 139, and second segment 150 of second joined area 141 as shown in FIGS. 1-3. Accordingly, in some embodiments, sole structure 110 can cover and otherwise conceal joined areas 139, 141 and seam 170.

Thus, the methods of the present disclosure can allow footwear 100 to be manufactured in an efficient manner. Knitted component 130 can be knit in a relatively short amount of time, and with relatively little waste of material. Also, the knitted component 130 formed according to these methods can advantageous support and comfort for the wearer because it can substantially encapsulate the foot with its unitary knit construction. Furthermore, tensile element 131 can provide further support and can similarly extend around a majority of the wearer's foot. Portions of knitted component 130 can also extend underneath the wearer's foot and can allow upper 120 to conform to the sole of the wearer's foot in some embodiments for added support and comfort.

While various embodiments have been described, the description is intended to be exemplary, rather than limiting and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims. Moreover, as used in the claims "any of" when referencing the previous claims is intended to mean: (i) any one claim; or (ii) any combination of two or more claims referenced.

We claim:

1. A method of knitting a knitted component for an upper of an article of footwear using a flat knitting machine, the upper configured to receive a foot of a wearer, wherein the flat knitting machine includes a first needle bed with a plurality of first needles arranged along a longitudinal axis, and wherein the flat knitting machine includes a second needle bed with a plurality of second needles arranged along the longitudinal axis, wherein the method comprises:

performing at least one pass of at least one yarn feeder along the longitudinal axis relative to the first and second needle beds to form a knit element;

feeding at least one yarn with the at least one feeder during the at least one pass;

forming, during the at least one pass, a plurality of first loops with the first needles to define a first portion of the knitted component;

forming, during the at least one pass, a plurality of second loops with the second needles to define a second portion of the knitted component; and placing a tensile element within the knit element, wherein the tensile element is distinct from the at least one yarn forming the first loops and the second loops, and wherein the tensile element extends through the first portion of the knitted component and the second portion of the knitted component, wherein the first portion defines an overfoot member of the upper, the overfoot member configured to cover over the foot of the wearer, and wherein the second portion defines an underfoot member of the upper, the underfoot member configured to extend under the foot of the wearer.

2. The method of claim 1, wherein feeding the at least one yarn with the at least one feeder during the pass includes feeding a first yarn with a first feeder and feeding a second yarn with a second feeder during the pass;

wherein forming, during the pass, the plurality of first loops includes forming the plurality of first loops with the first yarn and with the first needles to define the first portion of the knitted component; and wherein forming, during the pass, the plurality of second loops includes forming the plurality of second loops with the second yarn and with the second needles to define the second portion of the knitted component.

3. The method of claim 2, further comprising interlooping the first yarn and the second yarn during the pass to form a joined area of the knitted component.

4. The method of claim 1, wherein placing the tensile element within the knit element includes inlaying the tensile element in the knit element on a knitting machine.

5. The method of claim 4, wherein inlaying the tensile element includes continuously extending the tensile element between the first portion and the second portion.

6. The method of claim 1, further comprising forming a medial side of the knit element and forming a lateral side of the knit element; and wherein placing the tensile element includes extending the tensile element from the first portion on the medial side, across the second portion, to the first portion on the lateral side.

7. The method of claim 1, wherein placing the tensile element includes:

placing a first segment of the tensile element along the first portion;

placing a second segment of the tensile element along the first portion; and forming a tensile loop with a third segment of the tensile element, the third segment extending between the first segment and the second segment, the third segment being exposed from the knit element.

8. The method of claim 1, wherein the pass is a first pass, the method further comprising:

joining the first portion and the second portion at a first joined area;

performing a second pass of the at least one yarn feeder along the longitudinal axis relative to the first and second needle beds;

feeding the at least one yarn with the at least one yarn feeder during the second pass;

forming, during the second pass, a plurality of third loops with the first needles to define a third portion of the knitted component, the third portion defining a front heel area of the knitted component;

forming, during the second pass, a plurality of fourth loops with the second needles to define a fourth portion of the knitted component, the fourth portion defining a rear heel area of the knitted component; and joining the third portion and the fourth portion at a second joined area such that the third portion and the fourth portion are formed integrally, wherein the third portion and the fourth portion are configured to cooperatively define an ankle opening of the upper, the ankle opening being configured to allow passage of the foot into the upper.

9. The method of claim 8, wherein the second joined area is substantially continuous with first joined area.

10. The method of claim 1, further comprising forming a tubular structure with an opening, the first portion and the second portion cooperating to define the opening configured to allow passage of a foot into the upper.

11. The method of claim 10, further comprising:

knitting a first edge of the first portion and a second edge of the second portion, the first edge and the second edge cooperating to define the opening; and closing the opening by attaching the first edge and the second edge together to define a seam.

12. The method of claim 11, further comprising attaching a sole structure to upper, wherein attaching the sole structure includes covering at least a portion of the seam with the sole structure.

13. The method of claim 1, wherein the first portion is formed at a higher-gauge knit structure than the second portion.

14. The method of claim 1, further comprising:

forming the plurality of first loops with a first group of the first needles, the first loops formed integrally with a first neighboring area of the knitted component to at least partially define the first portion of the knitted component;

forming the plurality of second loops with a second group of the second needles, the second loops formed integrally with a second neighboring area of the knitted component to at least partially define the second portion of the knitted component;

forming floats at a plurality of first intervening needles of the first bed, the first intervening needles each disposed between pairs of the first needles in the first group;

forming floats at a plurality of second intervening needles of the second bed, the second intervening needles each disposed between pairs of the second needles in the second group; and wherein the first group of the first needles is offset relative to the second group of the second needles along the longitudinal axis.

15. A method of knitting a knitted component that includes a knit element and a tensile element, the knitted component configured for an upper of an article of footwear, the upper configured to receive a foot of a wearer, the method comprising:

performing a pass of a first yarn feeder and a second yarn feeder along a longitudinal axis relative to a first and a second needle bed of a knitting machine;

feeding a first yarn with the first yarn feeder and a second yarn with the second yarn feeder during the pass;

forming, during the pass, a plurality of first loops in the first yarn with the first needles to define a first portion of the knit element;

forming, during the pass, a plurality of second loops in the second yarn with the second needles to define a second portion of the knit element;

inlaying the tensile element in at least one of the first portion and the second portion while forming the at least one of the first portion and the second portion, wherein the tensile element is distinct from the first yarn and the second yarn;

wherein the first portion at least partially defines an overfoot member of the upper, the overfoot member configured to cover over the foot of the wearer; and wherein the second portion at least partially defines an underfoot member of the upper, the underfoot member configured to extend under the foot of the wearer.

16. The method of claim 15, further comprising interlooping the first yarn and the second yarn together at a joined area.

17. The method of claim 16, further comprising attaching a sole structure to the upper, wherein attaching the sole structure includes covering the joined area with the sole structure.

18. The method of claim 15, wherein inlaying the tensile element includes continuously extending the tensile element between the first portion and the second portion.

19. The method of claim 18, further comprising forming a medial side of the knit element and forming a lateral side of the knit element; and wherein inlaying the tensile element includes continuously extending the tensile element from the first portion on the medial side, across the second portion, to the first portion on the lateral side.

20. The method of claim 19, wherein inlaying the tensile element includes:

inlaying a first segment of the tensile element along the first portion;

inlaying a second segment of the tensile element along the first portion; and forming a tensile loop with a third segment of the tensile element, the third segment extending between the first segment and the second segment.

* * * * *